US010640338B2

(12) United States Patent
Hanamoto

(10) Patent No.: US 10,640,338 B2
(45) Date of Patent: May 5, 2020

(54) BOOM ATTACH/DETACH DEVICE OF CRANE AND BOOM ATTACH/DETACH METHOD FOR CRANE

(71) Applicant: KOBELCO CONSTRUCTION MACHINERY CO., LTD., Hiroshima-shi (JP)

(72) Inventor: Takahiro Hanamoto, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 32 days.

(21) Appl. No.: 15/559,592

(22) PCT Filed: Mar. 18, 2016

(86) PCT No.: PCT/JP2016/058673
§ 371 (c)(1),
(2) Date: Sep. 19, 2017

(87) PCT Pub. No.: WO2016/152770
PCT Pub. Date: Sep. 29, 2016

(65) Prior Publication Data

US 2018/0065832 A1 Mar. 8, 2018

(30) Foreign Application Priority Data

Mar. 20, 2015 (JP) ..... 2015-058033
Jul. 28, 2015 (JP) ..... 2015-148885

(51) Int. Cl.
*B66C 23/42* (2006.01)
*B66C 23/62* (2006.01)
(Continued)

(52) U.S. Cl.
CPC ..... *B66C 23/42* (2013.01); *B66C 23/26* (2013.01); *B66C 23/283* (2013.01); *B66C 23/365* (2013.01); *B66C 23/62* (2013.01)

(58) Field of Classification Search
CPC ..... B66C 23/42; B66C 23/26; B66C 23/62; B66C 23/283; B66C 23/365
See application file for complete search history.

(56) References Cited

U.S. PATENT DOCUMENTS 4,660,731 A * 4/1987 Becker ..... B66C 23/42 212/175
5,829,605 A * 11/1998 Poitras ..... B60P 3/125 212/180
(Continued)

FOREIGN PATENT DOCUMENTS

JP 50-24965 3/1975
JP 50-024965 A 3/1975
(Continued)

OTHER PUBLICATIONS

International Search Report dated May 24, 2016 in PCT/JP2016/058673 dated Mar. 18, 2016.
(Continued)

*Primary Examiner* — Michael E Gallion
(74) *Attorney, Agent, or Firm* — Oblon, McClelland, Maier & Neustadt, L.L.P.

(57) ABSTRACT

A boom attach/detach device includes a boom, an extensible cylinder, and a boom supporting device. At least a part of the boom supporting device is arranged more to a boom front end side than an upper slewing body. When the extensible cylinder conducts extension and contraction operation in a state where coupling between the upper slewing body and the boom by a boom foot pin is cut off, the boom supporting device supports the boom to enable a rear end portion of the boom to move in a boom axis direction. The boom can be
(Continued)

attached or detached with ease without a need to use a separate power device from a crane to suppress increases in size, in mass, and in cost of an upper slewing body.

17 Claims, 24 Drawing Sheets

(51) Int. Cl.

| | |
|---|---|
| ***B66C 23/26*** | (2006.01) |
| ***B66C 23/28*** | (2006.01) |
| ***B66C 23/36*** | (2006.01) |

(56) References Cited

U.S. PATENT DOCUMENTS

| | | | | |
|---|---|---|---|---|
| 6,032,809 | A * | 3/2000 | Irsch | B66C 23/42 212/181 |
| 6,516,917 | B1 * | 2/2003 | Mayer | B66C 23/80 182/17 |
| 9,150,390 | B2 * | 10/2015 | Willim | B66C 23/365 |
| 9,919,637 | B1 * | 3/2018 | Dieleman | B60P 3/064 |
| 2014/0291267 | A1 * | 10/2014 | Yamashita | B66C 23/365 212/180 |
| 2018/0282135 | A1 * | 10/2018 | Konijn | B66C 23/26 |

FOREIGN PATENT DOCUMENTS

| | | | |
|---|---|---|---|
| JP | 57-13885 | U | 8/1982 |
| JP | 57-138885 | | 8/1982 |
| JP | 57-138885 | U | 8/1982 |
| JP | 5-330790 | A | 12/1993 |
| JP | 2014-31231 | A | 2/2014 |

OTHER PUBLICATIONS

Japanese Office Action for JP2015-058033, dated Mar. 5, 2019. English machine translation provided.

Japanese Office Action for JP2015-058033, dated Sep. 11, 2018. English machine translation provided.

* cited by examiner

BOOM ATTACH/DETACH DEVICE OF CRANE AND BOOM ATTACH/DETACH METHOD FOR CRANE

TECHNICAL FIELD

The present invention relates to a boom attach/detach device of a crane, and a boom attach/detach method for a crane.

BACKGROUND ART

For example, Patent Literature 1 and the like recite techniques of attaching/detaching (mounting, dismounting) a boom to/from an upper slewing body. Patent Literature 1 recites, in FIG. 11, a technique of attaching/detaching a boom using a power device ("other lifting means" in Abstract of Patent Literature 1) separate from a crane to/from which the boom is attached/detached. Additionally, FIG. 1 to FIG. 8 and Abstract of Patent Literature 1 recite a technique of attaching/detaching a boom using a boom receiving base.

CITATION LIST

Patent Literature

Patent Literature 1: JP H5-330790 A

SUMMARY OF INVENTION

Problems to be Solved by the Invention

As recited in Abstract of Patent Literature 1, a boom receiving base enables a boom to be attached/detached without other lifting means. However, as recited in FIG. 3 and FIG. 4 of Patent Literature 1, the boom receiving base is arranged between a boom supporting bracket (a "foot bracket" in Patent Literature 1) and the boom. Therefore, there occurs a problem that a size of an upper slewing body is increased. Additionally, there occur a problem that a mass of the upper slewing body is increased by a mass of the boom receiving base, and a problem that a cost of the upper slewing body is increased. For example, in a case where the upper slewing body is transported, since a transport size and a transport mass are limited by laws and regulations, increases in size and mass of the upper slewing body are not desirable.

Under these circumstances, the present invention aims at providing a boom attach/detach device of a crane, and a boom attach/detach method for a crane, which device and method facilitate attachment/detachment of a boom without requiring a power device separate from a crane and enable increases in size, in mass, and in cost of an upper slewing body to be suppressed.

Solutions to Problems

A boom attach/detach device of a crane according to a first aspect includes an upper slewing body, a boom, a drive cylinder, and a boom supporting portion. The boom is attached to the upper slewing body via a boom foot pin so as to rise and fall. The drive cylinder is provided in the upper slewing body or the boom to drive the boom. The boom supporting portion supports the boom. At least a part of the boom supporting portion is arranged more to a boom front end side than the upper slewing body. When the drive cylinder conducts extension and contraction operation in a state where coupling between the upper slewing body and the boom by the boom foot pin is cut off, the boom supporting portion supports the boom so as to enable a rear end portion of the boom to move in a boom axis direction.

A boom attach/detach method for a crane according to a second aspect is used for a crane including a boom and a drive cylinder. The boom is attached to an upper slewing body via a boom foot pin so as to rise and fall. The drive cylinder is provided in the upper slewing body or the boom to drive the boom. In a state where the boom is supported at a position more to a boom front end side than the upper slewing body and coupling between the upper slewing body and the boom by the boom foot pin is cut off, the drive cylinder is caused to conduct extension and contraction operation to enable a rear end portion of the boom to move in a boom axis direction.

Effects of Invention

According to the first aspect, the boom can be attached/detached with ease without a need to use a separate power device from the crane, and increases in size, in mass, and in cost of the upper slewing body can be suppressed. According to the second aspect, the boom can be attached/detached with ease without a need to use a separate power device from the crane, and increases in size, in mass, and in cost of the upper slewing body can be suppressed.

DESCRIPTION OF EMBODIMENTS

With reference to FIG. 1 to FIG. 9F, a boom attach/detach device 1 of a first embodiment will be described.

Figure 1:
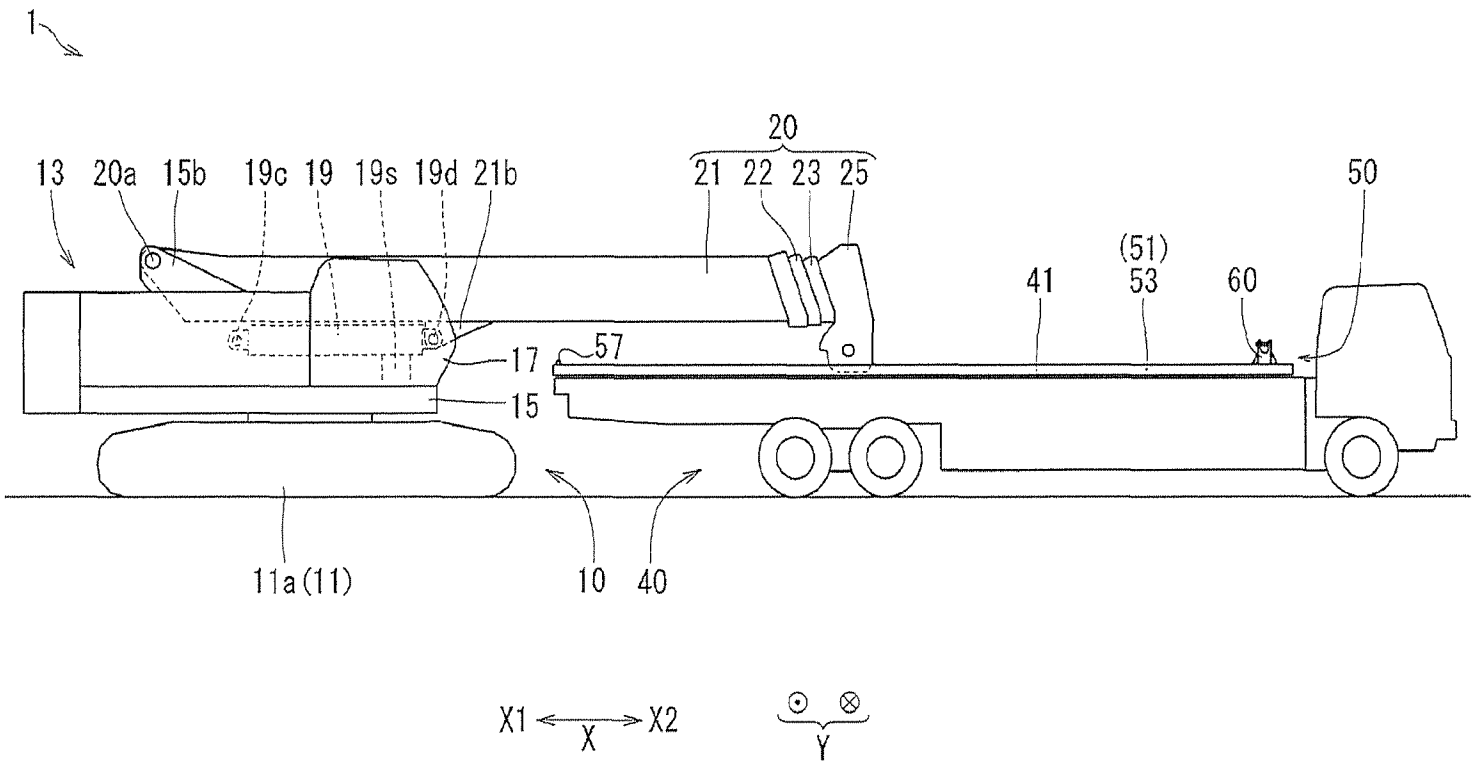
FIG. 1 is a general view of a boom attach/detach device 1.
Figure 2:
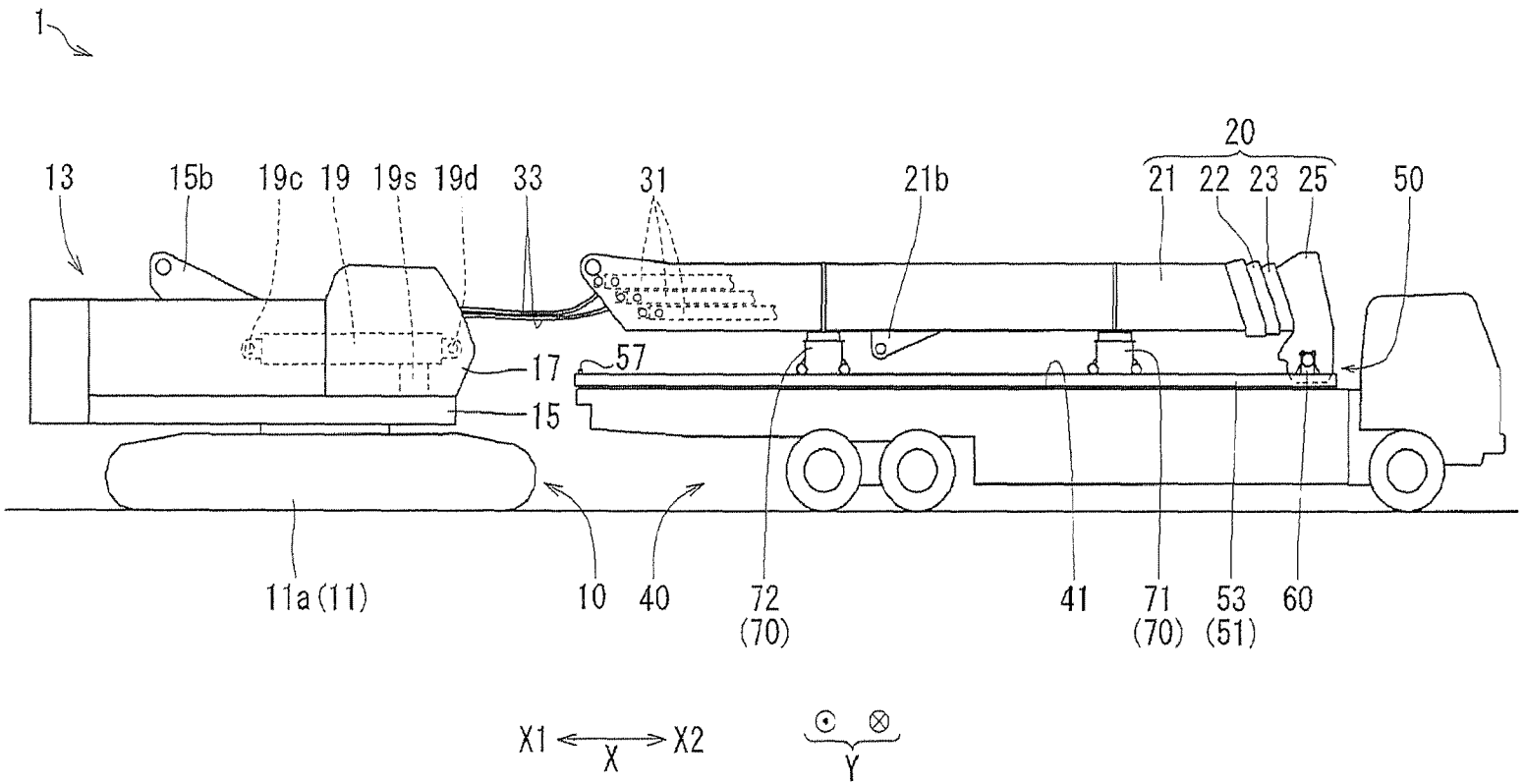
FIG. 2 is a view corresponding to FIG. 1, the view showing a state where a boom 20 is detached from an upper slewing body 13 shown in FIG. 1.

The boom attach/detach device 1 is a device which attaches/detaches a boom 20 (shown below) to/from an upper slewing body 13 (shown below) as shown in FIG. 1 and FIG. 2. As shown in FIG. 1, the boom attach/detach device 1 includes a crane 10, a truck 40 (transport carriage), and a boom supporting device 50 (boom supporting portion).

The crane 10 is a construction machine including the boom 20 (shown below), and more specifically, is a movable crane. The crane 10 includes a lower travelling body 11, the upper slewing body 13, a rising and falling cylinder 19 (drive cylinder), the boom 20, an extensible cylinder 31 (drive cylinder) (see FIG. 2), and a hydraulic hose for extension 33 (see FIG. 2).

The lower travelling body 11, which includes a crawler 11*a*, is a part for causing the crane 10 to travel.

The upper slewing body 13 is mounted on the lower travelling body 11 so as to be turnable with respect to the lower travelling body 11. The upper slewing body 13 includes a slewing frame 15 and a driver's room 17. On a part of the slewing frame 15, there is provided a boom supporting bracket 15*b* to which the boom 20 is attached. The driver's room 17 is mounted on the slewing frame 15.

The rising and falling cylinder 19 is a cylinder which causes the boom 20 to rise and fall with respect to the upper slewing body 13 and is a hydraulic cylinder. A base end portion of the rising and falling cylinder 19 is coupled to the slewing frame 15 via a rising and falling cylinder foot pin 19*c*. A front end portion of the rising and falling cylinder 19 is coupled to the boom 20 via a rising and falling cylinder rod pin 19*d*. A rising and falling cylinder supporting device 19*s* supports the rising and falling cylinder 19 with respect to the slewing frame 15 when the rising and falling cylinder 19 and the boom 20 are separated from each other (the rising and falling cylinder rod pin 19*d* is detached).

The boom 20 is a member to which a hook H1 (see FIG. 9A) or the like for hanging a hung load is attached. The boom 20 is attached to the upper slewing body 13 via a boom foot pin 20*a* so as to rise and fall with respect to the upper slewing body 13. The boom foot pin 20*a* is a pin which couples a base end portion (boom foot) of the boom 20 and the boom supporting bracket 15*b*. The boom foot pin 20*a* is a rotation shaft of the boom 20 with respect to the slewing frame 15. The boom 20 is box-shaped and extensible, and has an inserted structure (box-shaped extensible structure) and includes a plurality of stages of unit booms, specifically, four stages of unit booms. The boom 20 includes a base end boom 21, a second stage boom 22, a third stage boom 23, and a front end boom 25 in this order from the base end side (rear end side) to the front end side. In the following, description will be made of a case where the boom 20 is arranged such that a longitudinal direction of the boom 20 is a horizontal direction (or an approximately horizontal direction). An axis direction (the longitudinal direction) of the boom 20 is assumed to be a boom axis direction X. The boom 20 is extensible in the boom axis direction X. A side from the front end side toward the rear end side of the boom 20 (the rear side in the upper slewing body 13) is assumed to be a boom rear end side X1 and an opposite side thereof (the front side in the upper slewing body 13) is assumed to be a boom front end side X2. A width direction of the boom 20 (a horizontal direction orthogonal to the boom axis direction X) is assumed to be a boom width direction Y.

The base end boom 21 (basic boom) is a unit boom at the most rear position on the boom rear end side X1 among the plurality of unit booms constituting the boom 20. The base end boom 21 includes a rising and falling cylinder attachment bracket 21*b*. The rising and falling cylinder attachment bracket 21*b* is a part which is provided on a belly face (lower face) of the base end boom 21 and to which the rising and falling cylinder rod pin 19*d* is attached.

Figure 3:
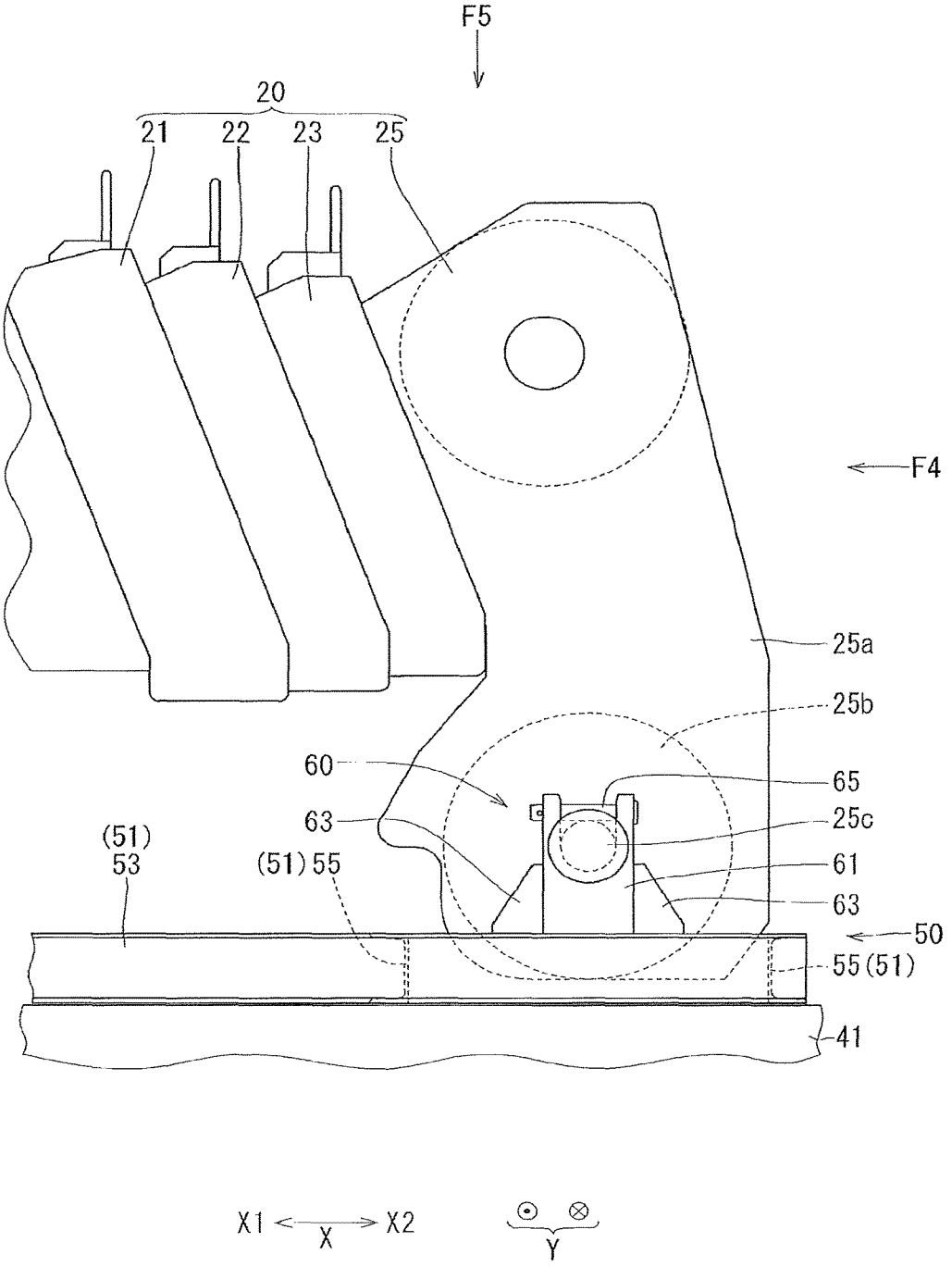
FIG. 3 is an enlarged view of a boom front end side supporting device 60 and the like shown in FIG. 2.
Figure 4:
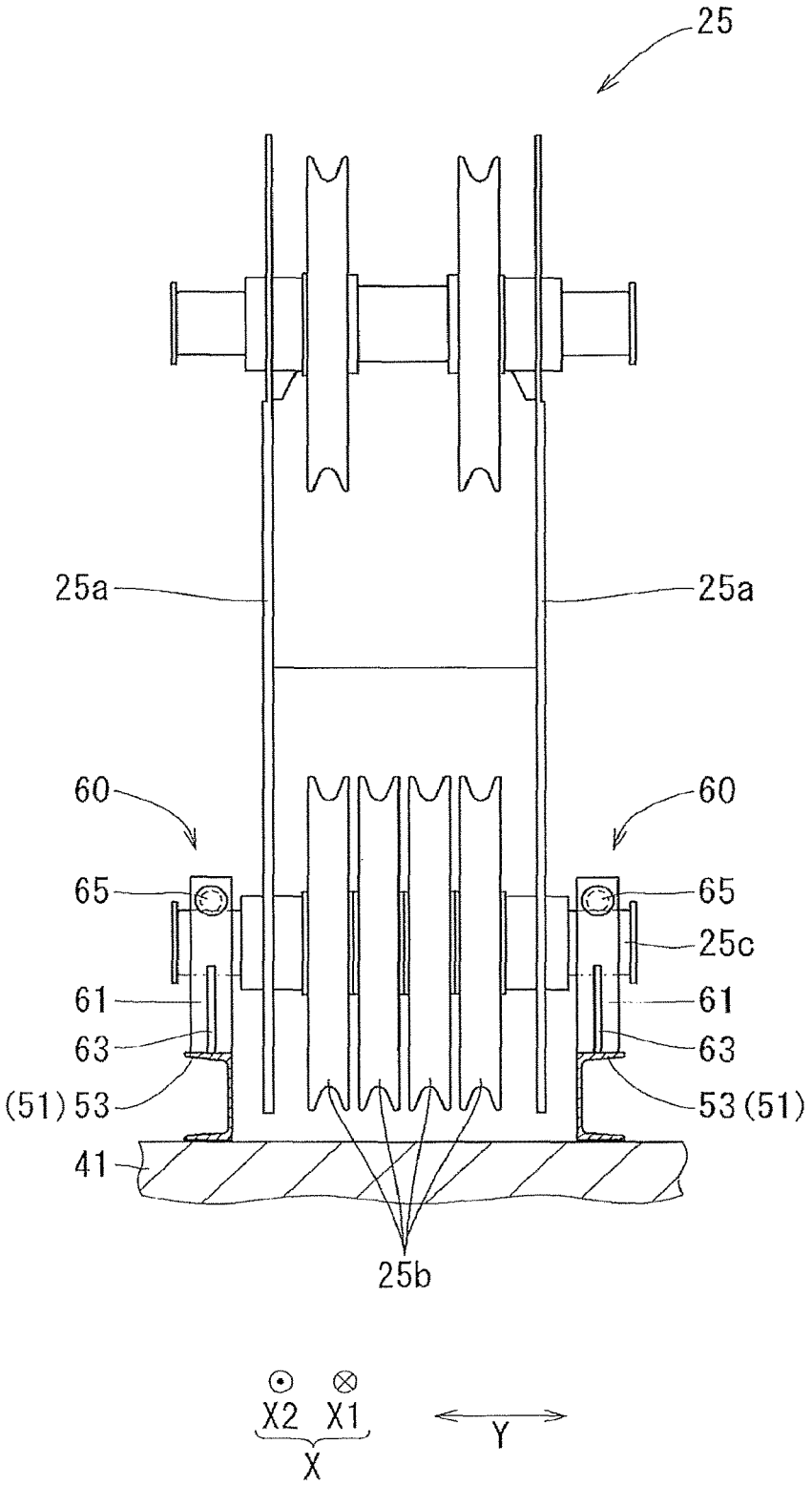
FIG. 4 is a view seen from a direction of an arrow F4 in FIG. 3.
Figure 9A:
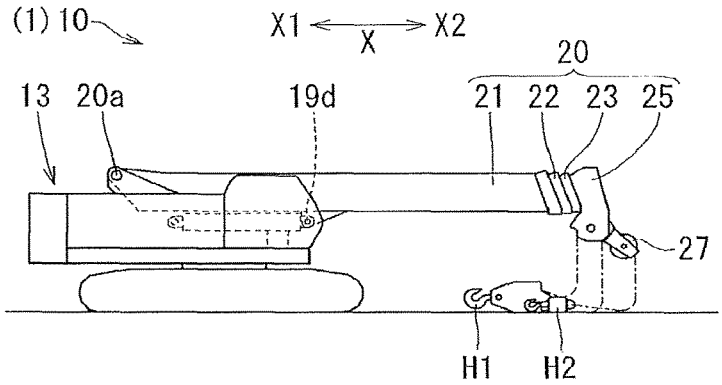
FIG. 9A is a view showing a crane 10 shown in FIG. 1.

The front end boom 25 is a unit boom at the most front position on the boom front end side X2 among the plurality of unit booms constituting the boom 20. As shown in FIG. 3, an end portion (front end portion) of the front end boom 25 on the boom front end side X2 includes a side plate 25*a*, a front end sheave 25*b*, and a boom point pin 25*c*. The side plates 25*a*, 25*a* are two plate members opposed to each other in the boom width direction Y as shown in FIG. 4. A plurality of, for example, four front end sheaves 25*b*, which are pulleys arranged in a lower end portion in the front end portion of the front end boom 25, are provided so as to be aligned in the boom width direction Y. On the front end sheave 25*b*, a lifting rope for hanging the hook H1 (see FIG. 9A) is hung. The boom point pin 25*c* (front end sheave fixing pin) is a pin which rotatably supports the front end sheave 25*b* with respect to the side plate 25*a*. The boom point pin 25*c* extends in the boom width direction Y to protrude more to the outer sides of the boom width direction Y than the two side plates 25*a*, 25*a*. As shown in FIG. 9A, an auxiliary sheave 27 for hanging an auxiliary hook H2 may be attached to the front end boom 25.

The extensible cylinder 31 (drive cylinder) is provided in the boom 20 to drive the boom 20 as shown in FIG. 2. The extensible cylinder 31 is a hydraulic cylinder arranged inside the boom 20 to cause the boom 20 to extend and contract.

The hydraulic hose for extension 33 is a hydraulic hose for supplying and discharging oil between the extensible cylinder 31 and the upper slewing body 13 and is connected to an end portion of the boom 20 on the boom rear end side X1 and to the upper slewing body 13.

The truck 40 (transport carriage) is a vehicle provided with a platform 41 for transporting a cargo. The truck 40 is a carriage for transporting the boom 20 and is capable of transporting cargoes other than the boom 20.

The boom supporting device 50 (boom supporting portion) is a device for supporting the boom 20. The boom supporting device 50 is arranged more to the boom front end side X2 than the slewing frame 15 and arranged more to the boom front end side X2 than the upper slewing body 13. The boom supporting device 50 is arranged at a position away from the upper slewing body 13 and is arranged more to the boom front end side X2 than the driver's room 17. The boom supporting device 50 is disposed on the truck 40, and more specifically, mounted (arranged) on the platform 41. The boom supporting device 50 includes a frame 51, a boom front end side supporting device 60 (boom front end side supporting portion), and a boom rear end side supporting device 70 (boom rear end side supporting portion).

The frame 51 is a part which supports the boom front end side supporting device 60 and the boom rear end side supporting device 70. The frame 51 is fixed to the platform 41 and is arranged to extend, for example, from an end portion of the platform 41 on the boom front end side X2 to an end portion of the boom rear end side X1. The frame 51 includes a rail 53, a lateral member 55 (see FIG. 5), and a stopper 57.

Figure 5:
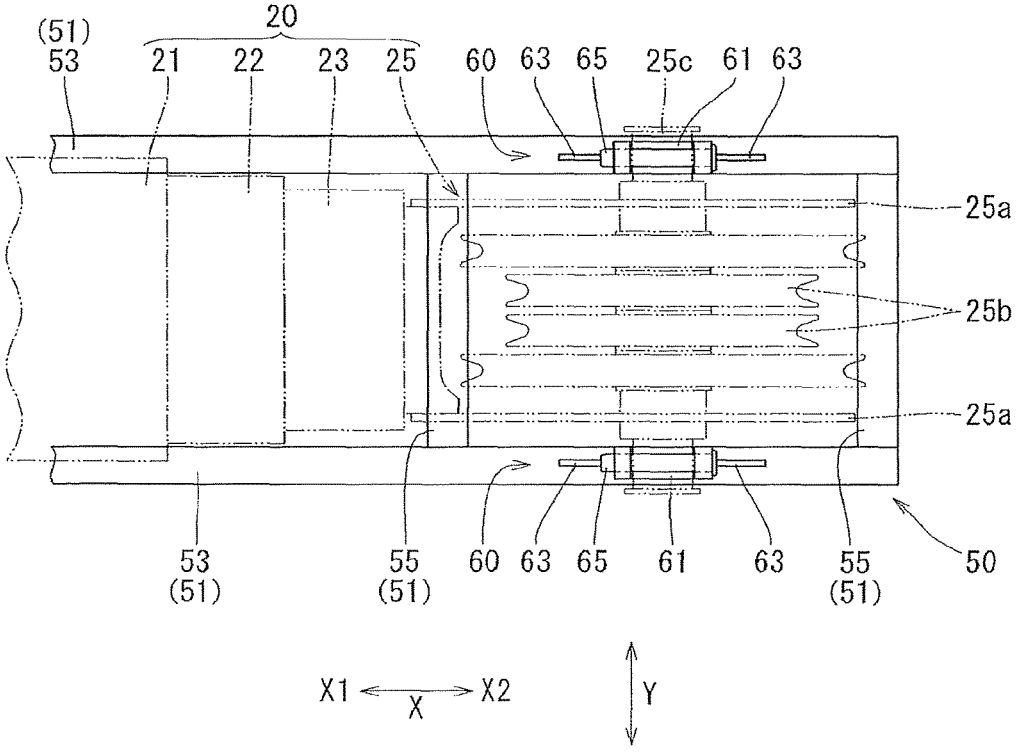
FIG. 5 is a view seen from a direction of an arrow F5 in FIG. 3.

The rail 53 is a rod-shaped member extending in the boom axis direction X. As shown in FIG. 5, a plurality of, specifically, two rails 53 are provided spaced apart in the boom width direction Y. In FIG. 5, the boom 20 is indicated by imaginary lines (chain double-dashed lines) (the same applies to FIG. 8). As shown in FIG. 4, a cross section of the rail 53 seen from the boom axis direction X is, for example, C-shaped or may be I-shaped or the like. As shown in FIG. 2, a length of the rail 53 in the boom axis direction X is approximately the same as a length of the base end boom 21.

As shown in FIG. 5, two lateral members 55, each of which is arranged in an end portion of the frame 51 on the boom front end side X2 or in the vicinity thereof, are provided spaced apart in the boom axis direction X. The two lateral members 55, 55 each extend in the boom width direction Y and are arranged so as to connect the two rails 53. A member (not shown) similar to the lateral member 55 is provided for joining the two rails 53.

As shown in FIG. 2, the stopper 57 is arranged in an end portion of the frame 51 on the boom rear end side X1 or in the vicinity thereof. The stopper 57 regulates movement of the boom rear end side supporting device 70 to the boom rear end side X1.

The boom front end side supporting device 60 (boom front end side supporting portion) is a part which supports a part of the boom 20 on the boom front end side X2, and more specifically, a part which supports the front end boom 25 and a device (jig, fixing jig) which supports the front end boom 25. As shown in FIG. 3, the boom front end side supporting device 60 includes a front end fixing portion 61, a reinforcing member 63, and a fixing pin 65.

The front end fixing portion 61 supports the front end boom 25, and more specifically, supports the boom point pin 25*c*, and has a U-shaped recess which supports (receives) the boom point pin 25*c* from below. As shown in FIG. 4, two front end fixing portions 61 are provided spaced apart in the boom width direction Y to support the boom point pins 25*c* which externally extend over the side plates 25*a* in the boom width direction Y. As shown in FIG. 3, the front end fixing portion 61 protrudes upwardly from the frame 51. The front end fixing portion 61 is fixed to the frame 51, and more specifically, fixed in the vicinity of an end portion of the rail 53 on the boom front end side X2, and fixed to the rail 53 at a position between the two lateral members 55, 55 (position in the boom axis direction X).

The reinforcing member 63 is a member which reinforces fixing (coupling) between the frame 51 and the front end fixing portion 61. The reinforcing member 63 is fixed to an end face (more specifically, both end faces) of the front end fixing portion 61 in the boom axis direction X, and to an upper face of the frame 51 (the rail 53), and is, for example, plate-shaped.

The fixing pin 65 is a pin (lock pin) for preventing the boom point pin 25*c* from coming off from the front end fixing portion 61. The fixing pin 65 is arranged above the boom point pin 25*c* received by the front end fixing portion 61 and is attached to the front end fixing portion 61 so as to connect upper end portions of the U-shaped recess of the front end fixing portion 61 in the boom axis direction X.

As shown in FIG. 2, the boom rear end side supporting device 70 is arranged more to the boom rear end side X1 than the boom front end side supporting device 60. The boom rear end side supporting device 70 supports the boom 20, and more specifically, supports the base end boom 21 and supports (receives) the base end boom 21 from below. The boom rear end side supporting device 70 is a carriage (support carriage) which is movable in the boom axis direction X. Movement of the boom rear end side supporting device 70 in the boom width direction Y is regulated. The boom rear end side supporting device 70 is configured to be adjustable to have an arbitrary height. A plurality of, specifically, two boom rear end side supporting devices 70 are provided spaced apart in the boom axis direction X. The boom rear end side supporting device 70 includes a first boom rear end side supporting device 71 and a second boom rear end side supporting device 72. The first boom rear end side supporting device 71 and the second boom rear end side supporting device 72 are similarly configured.

Figure 6:
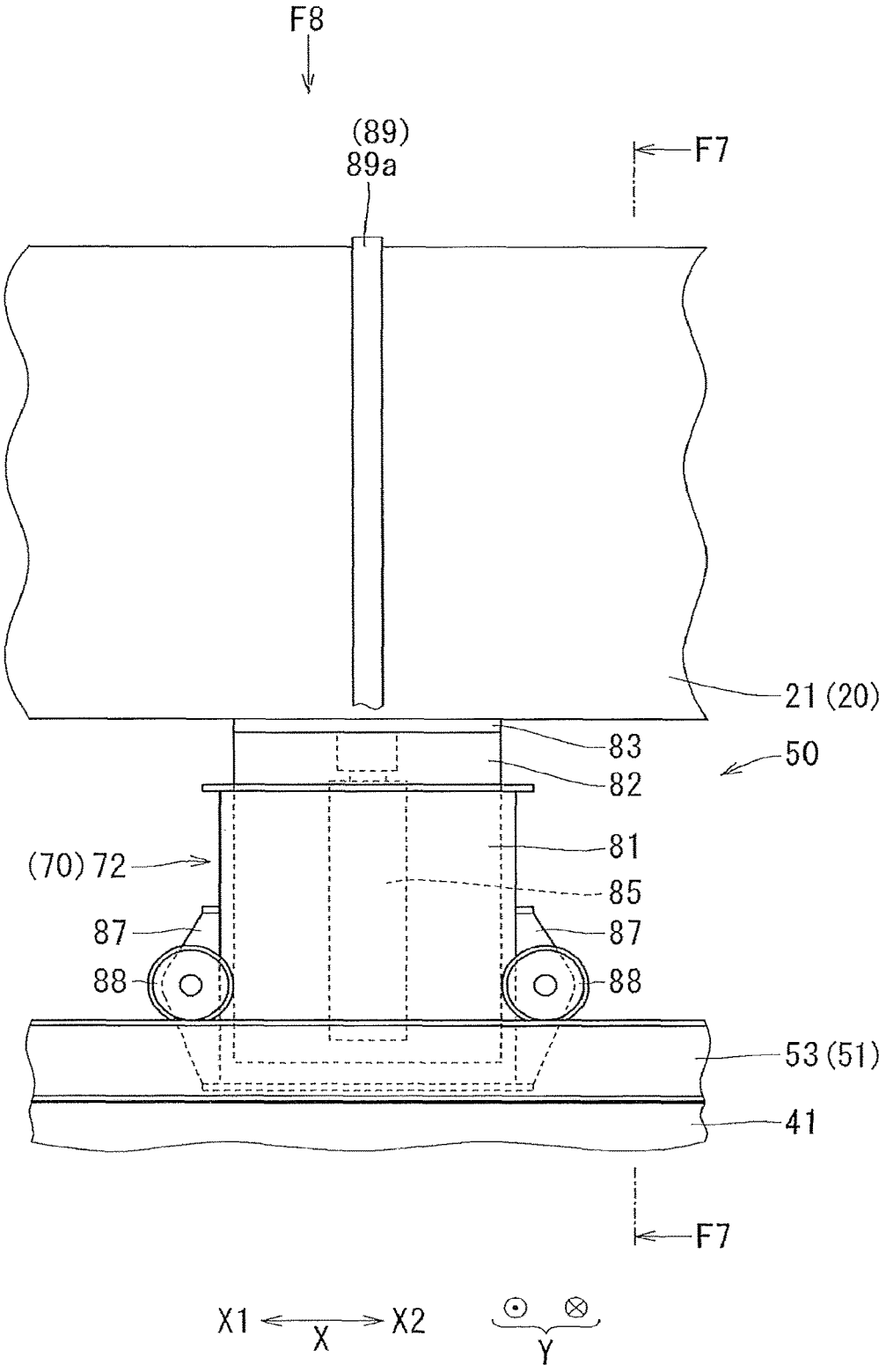
FIG. 6 is an enlarged view of a second boom rear end side supporting device 72 and the like shown in FIG. 2.

The second boom rear end side supporting device 72 is arranged more to the boom rear end side X1 than the first boom rear end side supporting device 71. As shown in FIG. 6, the second boom rear end side supporting device 72 includes an outer frame 81, an inner frame 82, a top plate 83, a lifting cylinder 85, wheel supporting portions 87, wheels 88, and a binding device 89.

Figure 7:
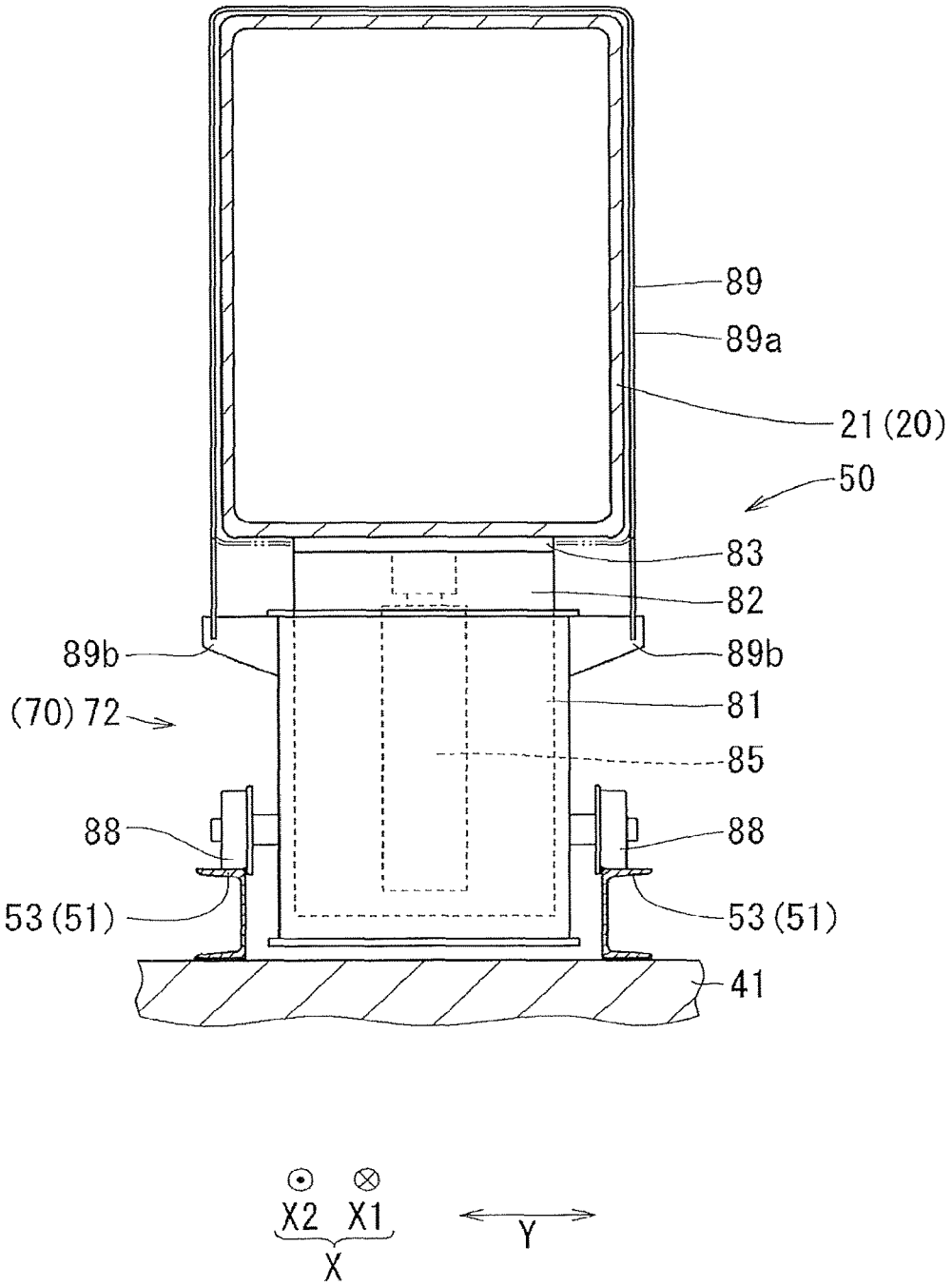
FIG. 7 is a sectional view seen from a direction of an arrow F7-F7 in FIG. 6.
Figure 8:
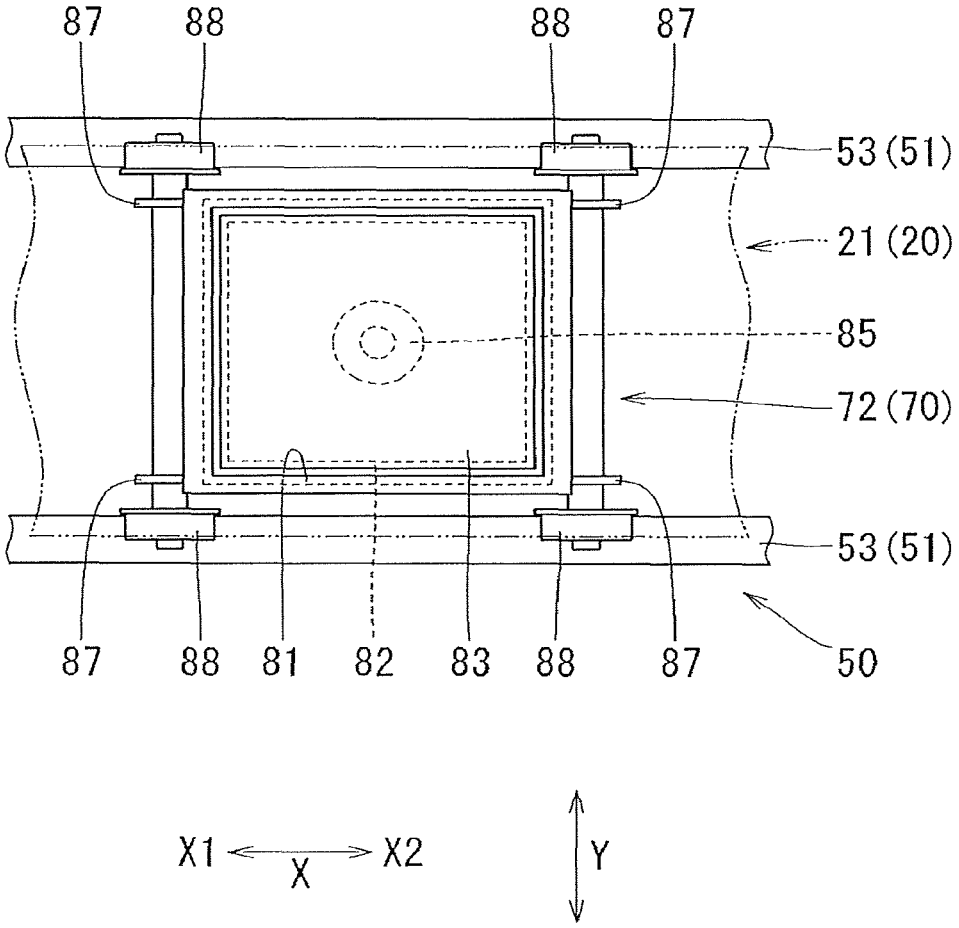
FIG. 8 is a view seen from a direction of an arrow F8 in FIG. 6.

The outer frame 81 and the inner frame 82 are configured to be nested and to be extensible in a vertical direction. The inner frame 82 is arranged inside the outer frame 81 and is vertically movable with respect to the outer frame 81. As shown in FIG. 8, the outer frame 81 and the inner frame 82 each have a frame-shape (circumference, a shape surrounding a space) seen from above, for example, a square-shape or the like. As shown in FIG. 6 and FIG. 7, the top plate 83 is a part in contact with the base end boom 21 (the boom 20) to support the base end boom 21 (the boom 20). The top plate 83 configures an upper end portion of the second boom rear end side supporting device 72 and is fixed to an upper end portion of the inner frame 82. A thickness direction of the top plate 83 is the vertical direction. In FIG. 7, illustration of an internal structure of the boom 20 is omitted.

The lifting cylinder 85 (support height changing portion) changes the top plate 83 (a part supporting the boom 20) to have an arbitrary height, and more specifically, moves the inner frame 82 and the top plate 83 vertically with respect to the outer frame 81. The lifting cylinder 85 is arranged inside the outer frame 81 and the inner frame 82 and is arranged below the top plate 83. The lifting cylinder 85 is a cylinder which is extensible in the vertical direction, for example, a hydraulic cylinder or the like.

The wheel supporting portions 87 are parts which support the wheels 88 with respect to the outer frame 81. The wheel supporting portions 87 are fixed to the outer frame 81, protrude from both sides of the outer frame 81 in the boom axis direction X, and are, for example, plate-shaped and orthogonal to, for example, the boom width direction Y.

The wheels 88 allow the second boom rear end side supporting device 72 to be movable (to be freely movable) in the boom axis direction X. The wheels 88 are attached to the outer frame 81 via the wheel supporting portions 87 so as to be rotatable with respect to the outer frame 81. The wheels 88 are arranged (mounted) on the rail 53 and are capable of rotating on the rail 53. As shown in FIG. 8, a plurality of, specifically, four wheels 88 are provided. The four wheels 88 are arranged spaced apart from each other in the boom axis direction X and the boom width direction Y and are arranged in the vicinity of four corners of the outer frame 81 when seen from above. Two each of the wheels 88 are arranged on one rail 53.

As shown in FIG. 7, the binding device 89 is a device for binding the base end boom 21 (the boom 20) to the second boom rear end side supporting device 72. The binding device 89 includes a binding member 89*a* and a binding member fixing portion 89*b*. The binding member 89*a* is a member capable of binding an outer circumference portion of the base end boom 21, and specifically, is a band, a belt, a rope, a chain, or the like, for example. A length of the binding member 89*a* is adjustable. Between the binding device 89 and the outer circumference portion of the base end boom 21, a pad member (not shown) can be provided, and, for example, a corner pad member can be provided which is fitted to a corner portion of the base end boom 21 when seen from the boom axis direction X. The binding member fixing portion 89*b* is a part to which the binding member 89*a* is fixed. The binding member fixing portion 89*b* is fixed to the outer frame 81, and more specifically, protrudes from the outer frame 81 to the outer side in the boom width direction Y. The binding member fixing portion 89*b* is provided with a part to which the binding member 89*a* is attached, and specifically, provided with a hook-shaped part or a hole (both of which are not shown), for example. In FIG. 7, as indicated by chain double-dashed lines, the binding member 89*a* can be fixed to the inner frame 82 or to the top plate 83.

(Boom Attach/Detach Method)

A boom attach/detach method by the boom attach/detach device 1 shown in FIG. 2 is roughly as follows. The boom 20 is set to be in a state of being supported at a position more to the boom front end side X2 than the upper slewing body 13 (see FIG. 9A to FIG. 9C). Additionally, coupling between the upper slewing body 13 and the boom 20 via the boom foot pin 20*a* and the rising and falling cylinder rod pin 19*d* is set to be in a state of being cut off. In these states, by causing the extensible cylinder 31 (the boom 20) to conduct extension and contraction operation, the base end boom 21 (the end portion of the boom 20 in the boom rear end side X1) is moved in the boom axis direction X. This causes the boom 20 to be attached/detached to/from the upper slewing body 13 (see FIG. 9D to FIG. 9F). Details of the boom attach/detach method are as follows.

(Detachment of Boom 20)

As shown in the order of FIG. 9A to FIG. 9F, the boom 20 is detached from the upper slewing body 13. In the following, description will be made of detachment of the boom 20 following a procedure.

The hook H1, the auxiliary sheave 27, and the auxiliary hook H2 shown in FIG. 9A are detached from the boom 20.

Figure 9B:
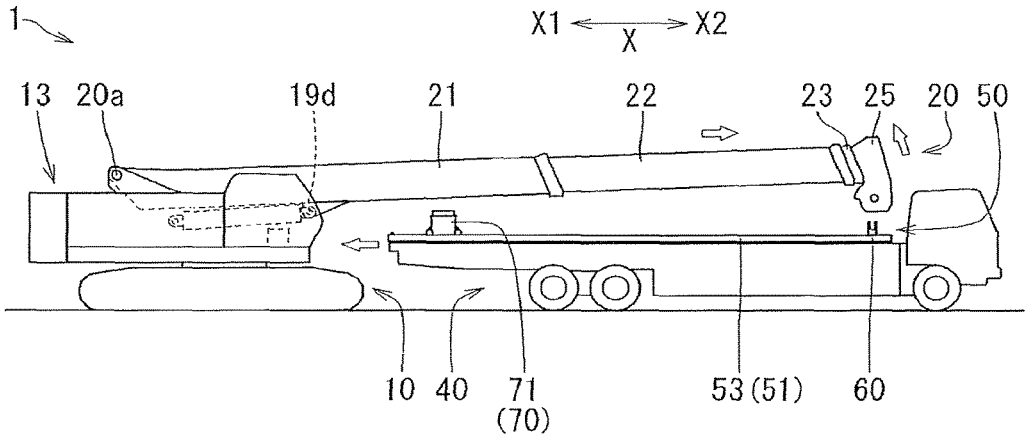
FIG. 9B is a view showing the boom attach/detach device 1 in the course of attachment/detachment of the boom 20 shown in FIG. 1.

As shown in FIG. 9B, the truck 40 moves to the front of the upper slewing body 13 (to the boom front end side X2) (moves backward). At this time, the truck 40 moves such that the rail 53 is arranged immediately below the boom 20. The boom 20 is extended a little further from the most contracted state to be raised slightly from the horizontal direction. As a result, the front end portion of the front end boom 25 is arranged immediately above the boom front end side supporting device 60.

The first boom rear end side supporting device 71 is arranged on the rail 53, and more specifically, arranged in an end portion (or the vicinity thereof) of the rail 53 on the boom rear end side X1.

Figure 9C:
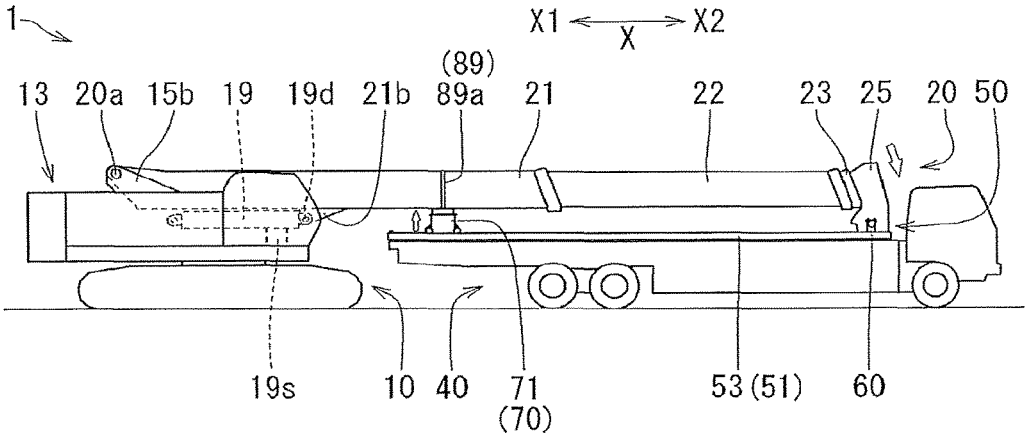
FIG. 9C is a view showing the boom attach/detach device 1 in the course of attachment/detachment of the boom 20 shown in FIG. 1.

As shown in FIG. 9C, the boom 20 is lowered and the front end portion of the front end boom 25 is lowered. As a result, as shown in FIG. 3, the boom point pin 25*c* is supported by (put on) the front end fixing portion 61. Attaching the fixing pin 65 to the front end fixing portion 61 results in fixing the boom point pin 25*c* to the front end fixing portion 61.

As shown in FIG. 9C, a height of the first boom rear end side supporting device 71 is adjusted. More specifically, by extending the lifting cylinder 85 shown in FIG. 6, the top plate 83 is caused to rise. As a result, the first boom rear end side supporting device 71 receives a load of the boom 20 to support the boom 20.

As shown in FIG. 9C, the base end boom 21 is bound to the first boom rear end side supporting device 71 by the binding device 89.

The boom foot pin 20*a* is detached from the base end boom 21 and the boom supporting bracket 15*b*. The rising and falling cylinder rod pin 19*d* is detached from the rising and falling cylinder 19 and the rising and falling cylinder attachment bracket 21*b*. At this time, the rising and falling cylinder 19 is supported by the rising and falling cylinder supporting device 19*s*. At this time, the load of the boom 20 is received by the first boom rear end side supporting device 71, and the front end boom 25 is fixed by the boom front end side supporting device 60. Accordingly, when the boom foot pin 20*a* is detached, the boom 20 is suppressed from moving (e.g., falling), which results in facilitating detachment of the boom foot pin 20*a* (the same applies to detachment of the rising and falling cylinder rod pin 19*d*). At this time, the boom 20 is allowed to conduct rising and falling operation with the boom point pin 25*c* (see FIG. 3) as an axis by the support by the boom front end side supporting device 60 (the front end fixing portion 61 (see FIG. 3)) and by the height-adjustable support by the first boom rear end side supporting device 71.

Figure 9D:
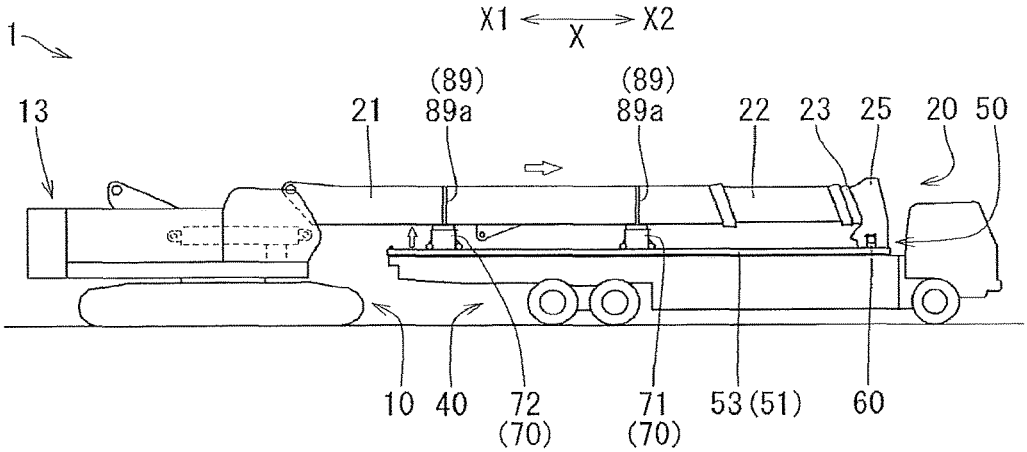
FIG. 9D is a view showing the boom attach/detach device 1 in the course of attachment/detachment of the boom 20 shown in FIG. 1.

As shown in FIG. 9D, the boom 20 is contracted by the extensible cylinder 31 (see FIG. 2). As a result, the base end boom 21 moves to the boom front end side X2 with respect to the front end boom 25 to detach the base end boom 21 from the upper slewing body 13 (from the boom supporting bracket 15*b*). At this time, the first boom rear end side supporting device 71 smoothly travels to move in the boom axis direction X along the rail 53 following the movement of the base end boom 21 (following extension of the boom 20). In a state where the boom 20 is contracted to some extent (a little longer than the most contracted length), contraction of the boom 20 is stopped.

The second boom rear end side supporting device 72 is disposed on the rail 53, and more specifically, is arranged in the end portion (or the vicinity thereof) of the rail 53 on the boom rear end side X1 and is arranged more to the boom rear end side X1 than the rising and falling cylinder attachment bracket 21*b*. Similarly to the first boom rear end side supporting device 71, a height of the second boom rear end side supporting device 72 is adjusted to bind the base end boom 21 by the binding device 89. At this time, according to the adjusted height of the second boom rear end side supporting device 72, the height of the first boom rear end side supporting device 71 can be adjusted.

Figure 9E:
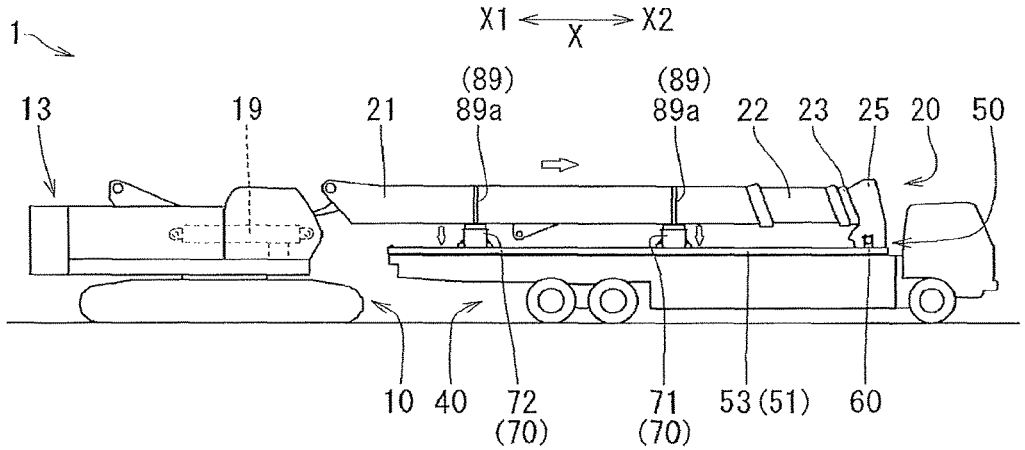
FIG. 9E is a view showing the boom attach/detach device 1 in the course of attachment/detachment of the boom 20 shown in FIG. 1.

As shown in FIG. 9E, the boom 20 is further contracted. More specifically, the boom 20 is contracted to a position at which an end portion (boom foot) of the boom 20 on the boom rear end side X1 and the rising and falling cylinder 19 does not interfere with each in the vertical direction. Then, the boom rear end side supporting device 70 is lowered.

Figure 9F:
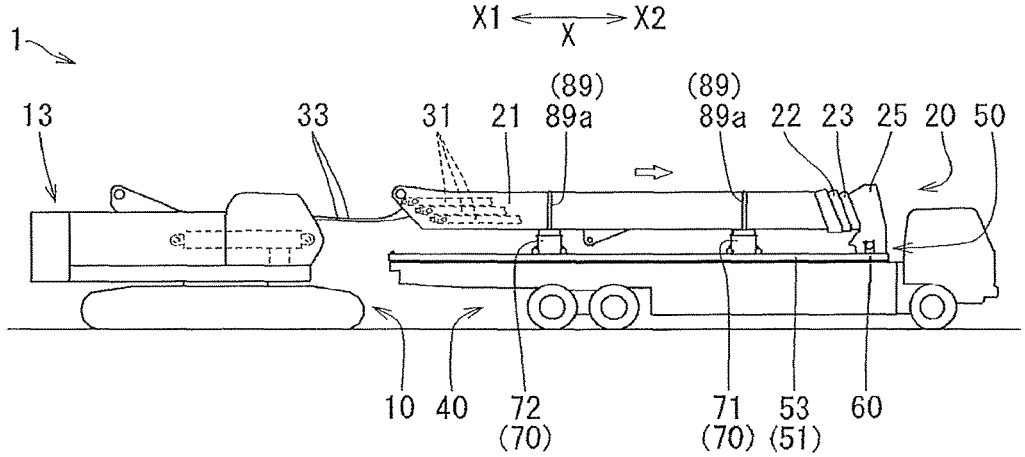
FIG. 9F is a view showing the boom attach/detach device 1 in the course of attachment/detachment of the boom 20 shown in FIG. 1.

As shown in FIG. 9F, the boom 20 is contracted until the boom 20 is in the most contracted state (or close to the most contracted state). Thereafter, the hydraulic hose for extension 33 is detached from the boom 20. Thereafter, the boom 20 is transported by the truck 40 while the boom 20 is being supported by the boom supporting device 50.

(Attachment of Boom 20)

By a procedure reverse to the above boom 20 attachment procedure (or by an approximately reverse procedure), the boom 20 is attached to the upper slewing body 13 in the order of FIG. 9F to FIG. 9A. In the following, description will be made of attachment of the boom 20 following the procedure. The description will be made assuming that an arrow indicating an operation order in FIG. 9A to FIG. 9F is reverse.

As shown in FIG. 9F, the hydraulic hose for extension 33 is attached to the boom 20. As shown in FIG. 9E, extension of the boom 20 by the extensible cylinder 31 (see FIG. 2) causes the base end boom 21 to move to the boom rear end side X1 with respect to the front end boom 25. At this time, the boom rear end side supporting device 70 travels to move to the boom rear end side X1 following the movement of the base end boom 21. The boom 20 is raised by raising the boom rear end side supporting device 70 to a position where the end portion (boom foot) of the boom 20 on the boom rear end side X1 and the rising and falling cylinder 19 does not interfere with each other.

As shown in FIG. 9D, the boom 20 is further extended. More specifically, the boom 20 is extended until the second boom rear end side supporting device 72 moves to the end portion (or the vicinity thereof) of the rail 53 on the boom rear end side X1.

The binding member 89*a* of the second boom rear end side supporting device 72 is detached from the boom 20. The second boom rear end side supporting device 72 is lowered, and the second boom rear end side supporting device 72 is detached from the rail 53.

As shown in FIG. 9C, the boom 20 is further extended and also the height of the first boom rear end side supporting device 71 is adjusted. At this time, the boom 20 is allowed to conduct rising and falling operation with the boom point pin 25*c* (see FIG. 3) as an axis by the support by the boom front end side supporting device 60 (the front end fixing portion 61 (see FIG. 3)) and the height-adjustable support by the first boom rear end side supporting device 71. As a result, a pin hole of the boom foot pin 20*a* and a pin hole of the rising and falling cylinder rod pin 19*d* are aligned in each vertical direction. With the alignment being conducted, the boom foot pin 20*a* is attached to the boom supporting bracket 15*b* and the boom 20. Additionally, with the alignment being conducted, the rising and falling cylinder rod pin 19*d* is attached to the rising and falling cylinder 19 and the rising and falling cylinder attachment bracket 21*b*. Accordingly, the boom foot pin 20*a* and the rising and falling cylinder rod pin 19*d* can be attached with ease.

The binding member 89*a* of the first boom rear end side supporting device 71 is detached from the boom 20. The fixing pin 65 of the boom front end side supporting device 60 shown in FIG. 3 is detached from the front end fixing portion 61.

As shown in FIG. 9C to FIG. 9B, rise of the boom 20 causes the boom point pin 25*c* shown in FIG. 3 to come off from the front end fixing portion 61. Thereafter, the truck 40 forward-retreats (moves to the boom front end side X2).

As shown in FIG. 9A, the hook H1, the auxiliary hook H2, and the auxiliary sheave 27 are attached to the boom 20.

Effect of First Invention

Effects of the boom attach/detach device 1 shown in FIG. 1 are as follows. The boom attach/detach device 1 includes the upper slewing body 13, the boom 20, the extensible cylinder 31, and the boom supporting device 50. The boom 20 is attached to the upper slewing body 13 via the boom foot pin 20*a* so as to rise and fall. The extensible cylinder 31 (drive cylinder) is provided in the upper slewing body 13 or in the boom 20 to drive the boom 20. The boom supporting device 50 supports the boom 20.

[Configuration 1-1]

At least a part of the boom supporting device 50 is arranged more to the boom front end side X2 than the upper slewing body 13.

[Configuration 1-2]

When the extensible cylinder 31 conducts extension and contraction operation in a state where coupling between the upper slewing body 13 and the boom 20 by the boom foot pin 20*a* is cut off, the boom supporting device 50 supports the boom 20 so as to enable the end portion (rear end portion) of the boom 20 on the boom rear end side X1 to be movable in the boom axis direction X.

In the Configuration 1-2, as power for attaching/detaching the boom 20 to/from the upper slewing body 13, extension and contraction operation of the extensible cylinder 31 is used. Accordingly, the boom 20 can be attached/detached without a need to use a separate power device from the crane 10.

In the Configuration 1-1, at least a part of the boom supporting device 50 is provided separately from the upper slewing body 13. Accordingly, it is not necessary to provide the upper slewing body 13 with a structure for supporting the boom 20 at the time of attachment/detachment of the boom 20. Alternatively, the boom supporting device 50 to be disposed in the upper slewing body 13 can be reduced in size (see, for example, a first guide roller device 351 of a third embodiment shown in FIG. 12). Accordingly, increases in size, in mass, and in cost of the upper slewing body 13 can be suppressed.

For example, as compared with a case where "the boom receiving base" recited in Patent Literature 1 is provided in the upper slewing body 13, since in the present embodiment, a gap between the boom supporting bracket 15*b* and the boom 20 in the width direction can be reduced, the width of the upper slewing body 13 can be made narrower. Additionally, since it is not necessary to provide the upper slewing body 13 with a boom receiving base, it is possible to suppress an increase in size of the upper slewing body 13, an increase in mass of the upper slewing body 13, and an increase in cost of the upper slewing body 13. As a result of suppressing the increases in size and in mass of the upper slewing body 13, amounts of fuel and exhaust gas necessary for operation of the crane 10 can be suppressed. Additionally, a vehicle for transporting the upper slewing body 13 can be reduced in size, amounts of fuel and exhaust gas necessary for transporting the upper slewing body 13 can be suppressed, and the cost necessary for transporting the upper slewing body 13 can be suppressed.

Effect of Second Invention

[Configuration 2]

The boom 20 is extensible. The drive cylinder is the extensible cylinder 31 which causes the boom 20 to extend and contract.

In the Configuration 2, as power for attaching/detaching the boom 20 to/from the upper slewing body 13, extension and contraction operation of the extensible cylinder 31 (i.e., extension and contraction operation of the boom 20) can be used.

Effect of Third Invention

[Configuration 3]

As shown in FIG. 2, the boom supporting device 50 includes the boom front end side supporting device 60, and the boom rear end side supporting device 70 arranged more to the boom rear end side X1 than the boom front end side supporting device 60.

As compared with a case where only one of the boom front end side supporting device 60 and the boom rear end side supporting device 70 is provided, this Configuration 3 enables the boom 20 to be securely supported. Accordingly, the boom 20 can be securely attached/detached to/from the upper slewing body 13.

Effect of Fourth Invention

[Configuration 4]

The boom supporting device 50 includes the rail 53 extending in the boom axis direction X. The boom rear end side supporting device 70 is movable in the boom axis direction X along the rail 53.

With this Configuration 4, the boom rear end side supporting device 70 moves following the extension and contraction operation of the boom 20. Accordingly, the boom rear end side supporting device 70 is allowed to securely support the boom 20 conducting the extension and contraction operation. Additionally, as compared with a case where the boom rear end side supporting device 70 does not move along the rail 53, the boom rear end side supporting device 70 is more likely to move smoothly, so that noise caused by movement of the boom rear end side supporting device 70 can be suppressed more easily.

Effect of Fifth Invention

[Configuration 5]

The boom rear end side supporting device 70 includes the lifting cylinder 85 (support height changing portion) which changes the top plate 83 (the part supporting the boom 20) to have an arbitrary height as shown in FIG. 6.

With this Configuration 5, the following effect can be obtained at the time of attaching the boom 20. When the top plate 83 supports the boom 20 (see FIG. 9D), by changing a height of the top plate 83 by the lifting cylinder 85, a height of the boom 20 can be changed. Accordingly, the pin hole of the boom foot pin 20*a* (see FIG. 1) can be aligned with ease. As a result, insertion work of the boom foot pin 20*a* can be conducted with ease. Additionally, when attachment of the rising and falling cylinder rod pin 19*d* is conducted, the Configuration 5 enables alignment of the pin hole of the rising and falling cylinder rod pin 19*d* to be conducted with ease.

With the Configuration 5, the effect can be obtained at the time of attaching the boom 20. In a state where the top plate 83 does not support the boom 20 (see the state between FIG. 9B and FIG. 9C), raising the height of the top plate 83 by the lifting cylinder 85 allows the boom rear end side supporting device 70 to support the boom 20. Accordingly, as shown in FIG. 9C, since the boom foot pin 20*a* can be detached with the boom 20 being supported, the boom foot pin 20*a* can be securely detached.

Effect of Sixth Invention

[Configuration 6]

As shown in FIG. 2, the plurality of boom rear end side supporting devices 70 are provided spaced apart in the boom axis direction X.

As compared with a case where only one boom rear end side supporting device 70 is provided, this Configuration 6 enables the boom 20 to be supported more stably.

Effect of Thirteenth Invention

[Configuration 13]

The boom supporting device 50 is provided on the truck 40 (the transport carriage) for transporting the boom 20.

This Configuration 13 allows the truck 40 to transport the boom 20 while the boom 20 is supported by the boom supporting device 50 provided on the truck 40 after detachment work of the boom 20.

Additionally, with the Configuration 13, the following effect can be obtained in a case where the boom 20 is transported in a state where the boom 20 is supported by the boom supporting device 50 provided on the truck 40 before attachment work of the boom 20. In this case, attachment work of the boom 20 can be started while the boom 20 remains in the state at the time of transportation.

Effect of Fourteenth Invention

Effects obtained by a boom attach/detach method according to the present embodiment are as follows. This boom attach/detach method is used by the crane 10 including the boom 20 and the extensible cylinder 31 shown in FIG. 2. The boom 20 is attached to the upper slewing body 13 via the boom foot pin 20*a* so as to rise and fall. The extensible cylinder 31 (the drive cylinder) is provided in the upper slewing body 13 or the boom 20 to drive the boom 20.

[Configuration 14]

In a state where the boom 20 is supported at a position more to the boom front end side X2 than the upper slewing body 13 and coupling between the upper slewing body 13 and the boom 20 via the boom foot pin 20*a* is cut off, the extensible cylinder 31 is caused to conduct extension and contraction operation. This extension and contraction operation causes the end portion of the boom 20 on the boom rear end side X1 to move in the boom axis direction X.

With this Configuration 14, the same effect as that described above in the "Effect of First Invention" can be obtained.

Effect of Fifteenth Invention

[Configuration 15]

In the boom attach/detach method, the boom 20 is extensible, and the drive cylinder is the extensible cylinder 31 which causes the boom 20 to extend and contract.

With this Configuration 15, the same effect as that described above in the "Effect of Second Invention" can be obtained.

Second Embodiment

Figure 10:
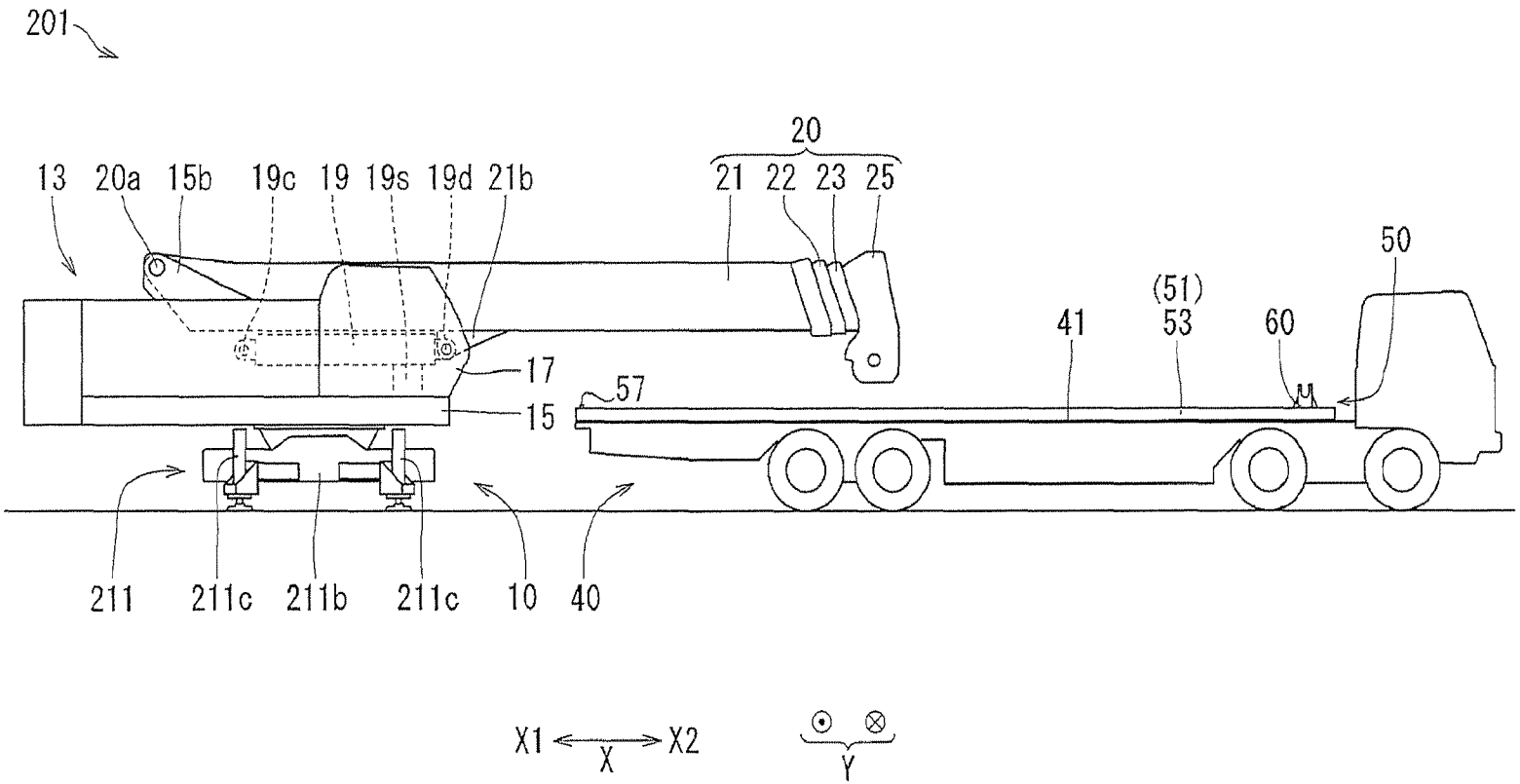
FIG. 10 is a view of a second embodiment corresponding to FIG. 1.
Figure 11A:
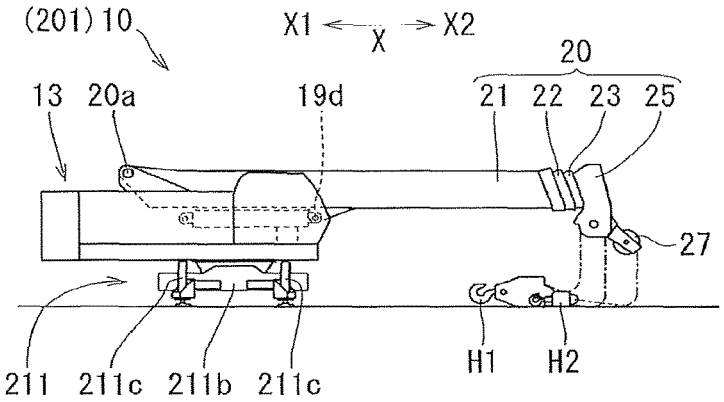
FIG. 11A is a view of the second embodiment corresponding to FIG. 9A.
Figure 11B:
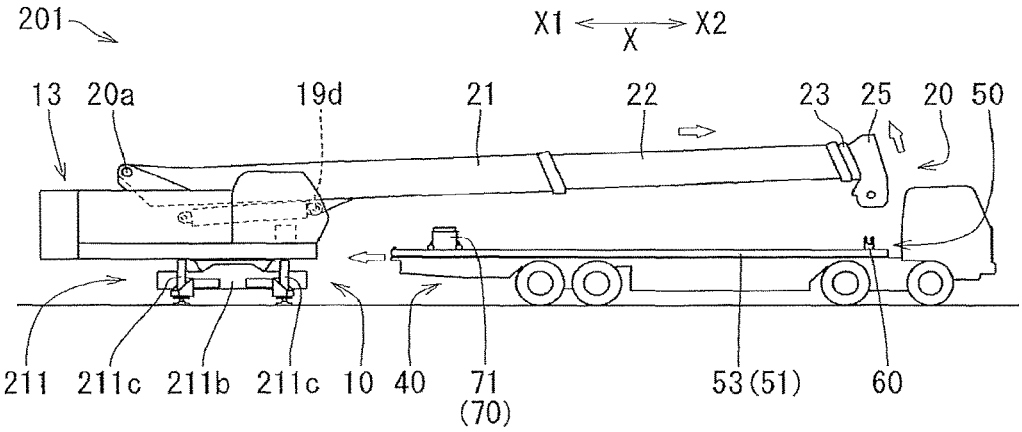
FIG. 11B is a view of the second embodiment corresponding to FIG. 9B.
Figure 11C:
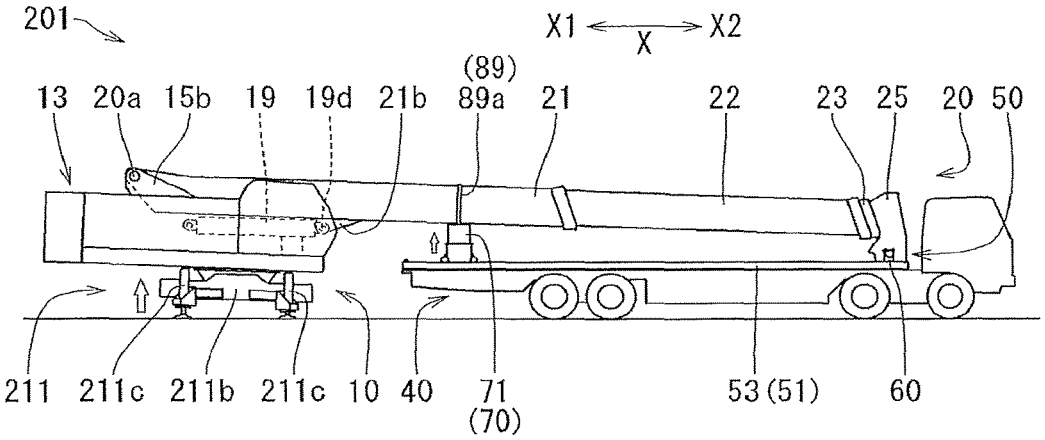
FIG. 11C is a view of the second embodiment corresponding to FIG. 9C.
Figure 11D:
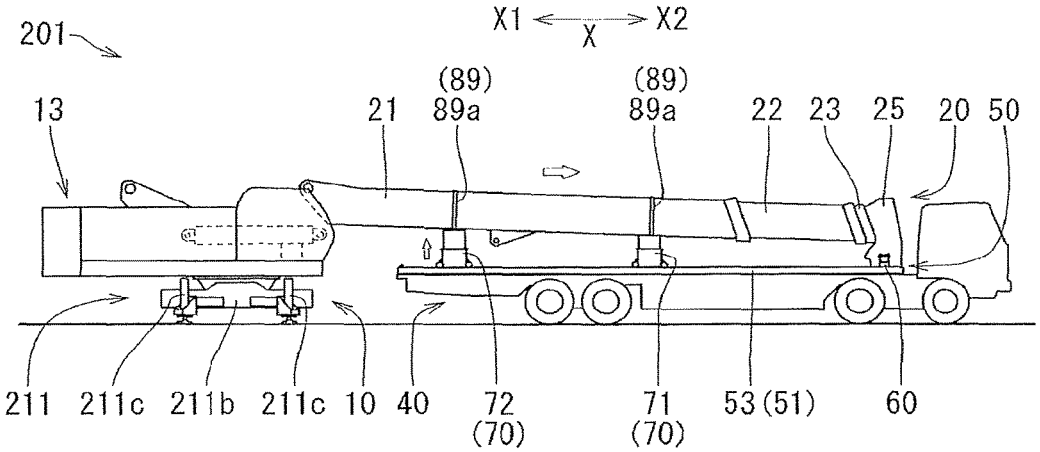
FIG. 11D is a view of the second embodiment corresponding to FIG. 9D.
Figure 11E:
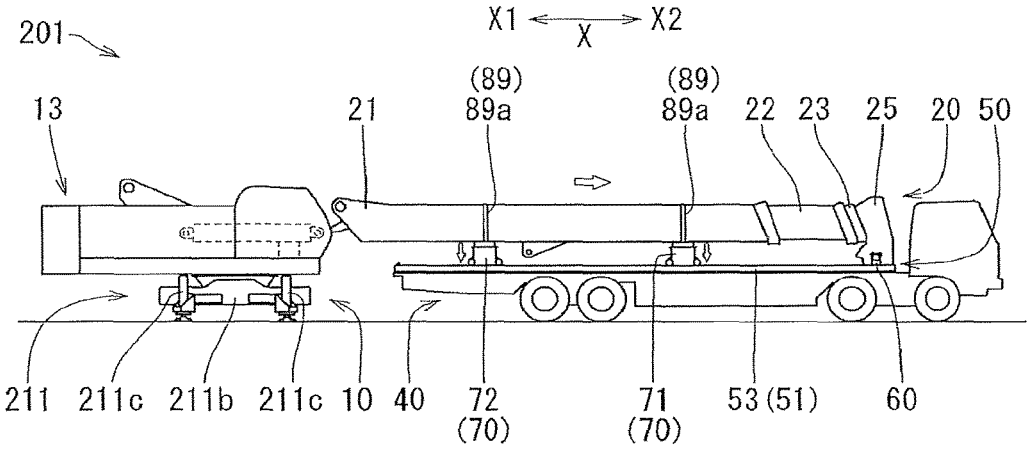
FIG. 11E is a view of the second embodiment corresponding to FIG. 9E.
Figure 11F:
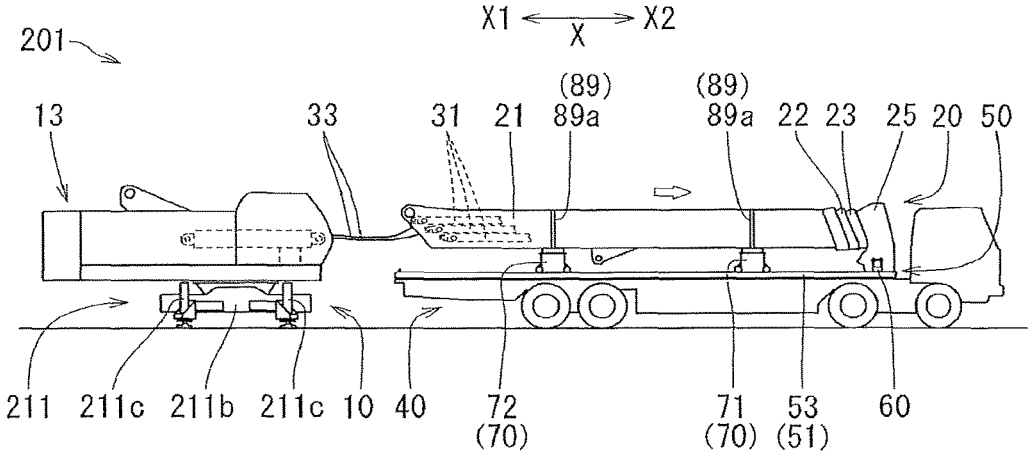
FIG. 11F is a view of the second embodiment corresponding to FIG. 9F.

With reference to FIG. 10 to FIG. 11F, description will be made of a difference of a boom attach/detach device 201 of a second embodiment shown in FIG. 10 from the first embodiment. Of the boom attach/detach device 201, common parts to those of the first embodiment are applied the same reference signs as in the first embodiment to omit description thereof.

While in the first embodiment, the lower travelling body 11 includes the crawler 11*a* as shown in FIG. 1, in the second embodiment, a lower travelling body 211 (lower main body) does not include a crawler 11*a* (see FIG. 1) as shown in FIG. 10. This is because in the second embodiment, a crane 10 is in the course of being disassembled (or assembled), that is, the crawler 11*a* is in a state of being detached from the lower travelling body 211. At this time, a jack 211*c* is attached to a car body 211*b* of the lower travelling body 211.

The car body 211*b* is a part to which the crawler 11*a* is attached (see FIG. 1).

The jack 211*c* (translifter) is a hydraulic jack (hydraulic cylinder) to be attached to the car body 211*b*. The jack 211*c* lifts up an upper slewing body 13 to an arbitrary height. More specifically, the jack 211*c* is capable of arbitrarily changing the height of the upper slewing body 13 with respect to the ground by lifting up the car body 211*b* from the ground, and is capable of arbitrarily changing an inclination of the upper slewing body 13 with respect to the ground. The jacks 211*c* are provided at a plurality of positions, specifically, provided at four positions, and arranged spaced apart from each other in a boom axis direction X and a boom width direction Y.

(Boom Attach/Detach Method)

As shown in the order of FIG. 11A to FIG. 11F, a boom 20 is detached from the upper slewing body 13. As shown in the order of FIG. 11F to FIG. 11A, the boom 20 is attached to the upper slewing body 13. Differences of a boom attach/detach method of the second embodiment from the first embodiment are as follows.

(Detachment of Boom 20)

As shown in FIG. 9C in the first embodiment, at the time of detachment of the boom 20, lowering of the boom 20 causes the front end boom 25 to be supported by the boom front end side supporting device 60.

On the other hand, since in the second embodiment shown in FIG. 10, for example, because a platform 41 is lower as compared to the first embodiment, or the like, merely lowering the boom 20 cannot cause a boom front end side supporting device 60 to support a front end boom 25. Therefore, as shown in FIG. 11C, the height of the upper slewing body 13 with respect to the ground is adjusted by the jack 211*c* and the inclination of the upper slewing body 13 with respect to the ground is adjusted. More specifically, a rear side part (a boom rear end side X1) of the upper slewing body 13 is raised higher than a front side part (a boom front end side X2). As a result, the front end boom 25 is supported by the boom front end side supporting device 60.

(Attachment of Boom 20)

In the first embodiment, at the time of attachment of the boom 20, adjustment of the height of the first boom rear end side supporting device 71 shown in FIG. 9C leads to alignment of the pin hole of the boom foot pin 20*a* and the pin hole of the rising and falling cylinder rod pin 19*d* in each vertical direction.

On the other hand, in the second embodiment, for example, the above pin holes cannot be aligned merely by the height adjustment of the first boom rear end side supporting device 71. Therefore, as shown in FIG. 11C, the jack 211*c* adjusts the height and the inclination of the upper slewing body 13. As a result, a pin hole of a boom foot pin 20*a* and a pin hole of a rising and falling cylinder rod pin 19*d* are aligned in a vertical direction.

Effect of Seventh Invention

Effects obtained by the boom attach/detach device 201 shown in FIG. 10 are as follows. The boom attach/detach device 201 includes the jack 211*c*.

[Configuration 7]

The jack 211*c* lifts up the upper slewing body 13 to an arbitrary height.

With this Configuration 7, the following effect can be obtained at the time of detachment of the boom 20. By lifting up the upper slewing body 13 by the jack 211*c* to an arbitrary height, the boom 20 attached to the upper slewing body 13 can be changed to have an arbitrary height. Accordingly, the boom 20 can be appropriately supported by the boom supporting device 50.

With the Configuration 7, the following effect can be obtained at the time of attachment of the boom 20. By lifting up the upper slewing body 13 by the jack 211*c* to an arbitrary height, the pin hole of the boom foot pin 20*a* of the upper slewing body 13 (a boom supporting bracket 15*b*) can be changed to have an arbitrary height. Accordingly, the boom foot pin 20*a* can be attached with ease.

Third Embodiment

Figure 12:
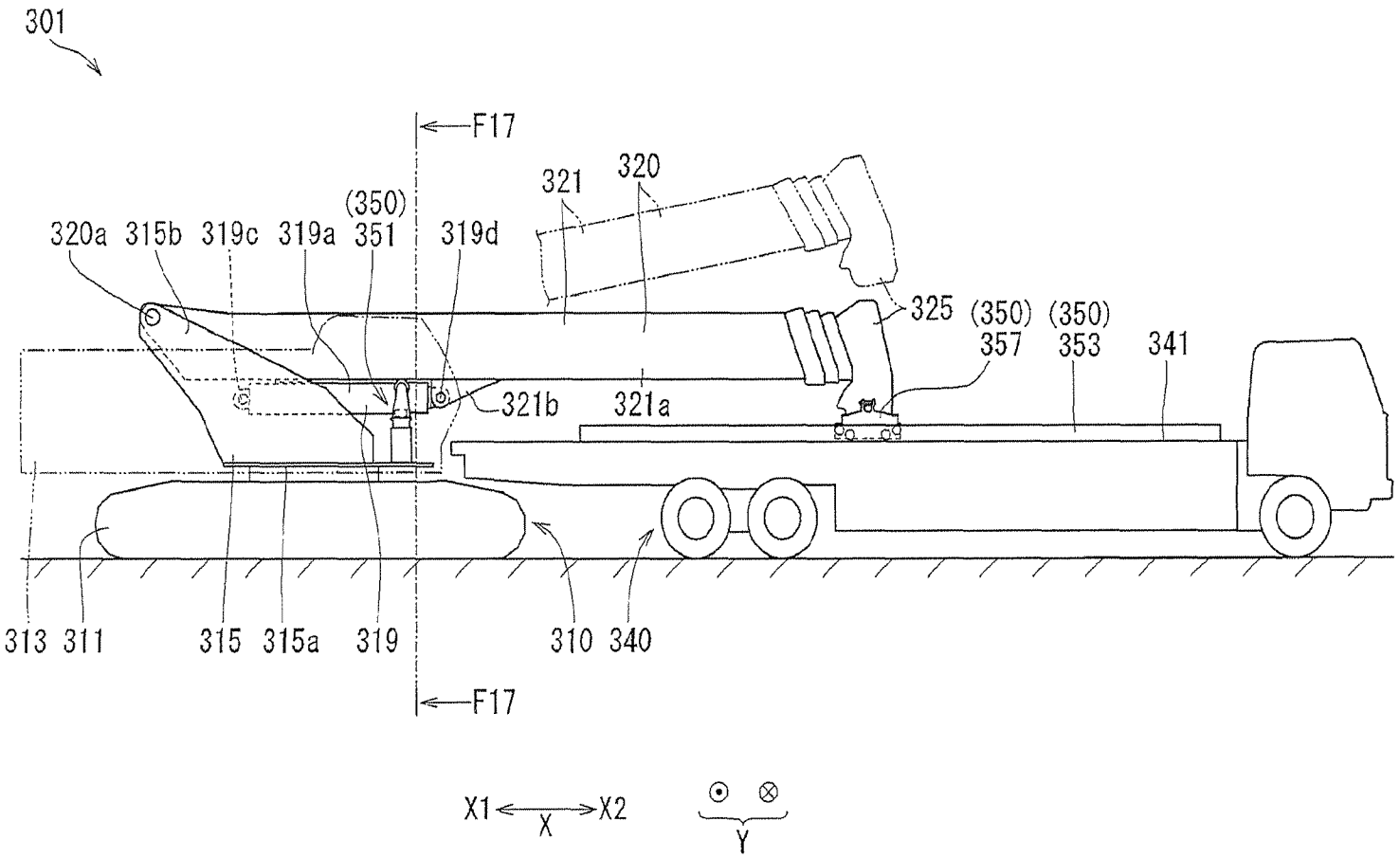
FIG. 12 is a view of a third embodiment corresponding to FIG. 1.

With reference to FIG. 12 to FIG. 20, description will be made of a boom attach/detach device 301 of a third embodiment shown in FIG. 12. Of the boom attach/detach device 301, description of common parts to those of the first embodiment is omitted.

Figure 17:
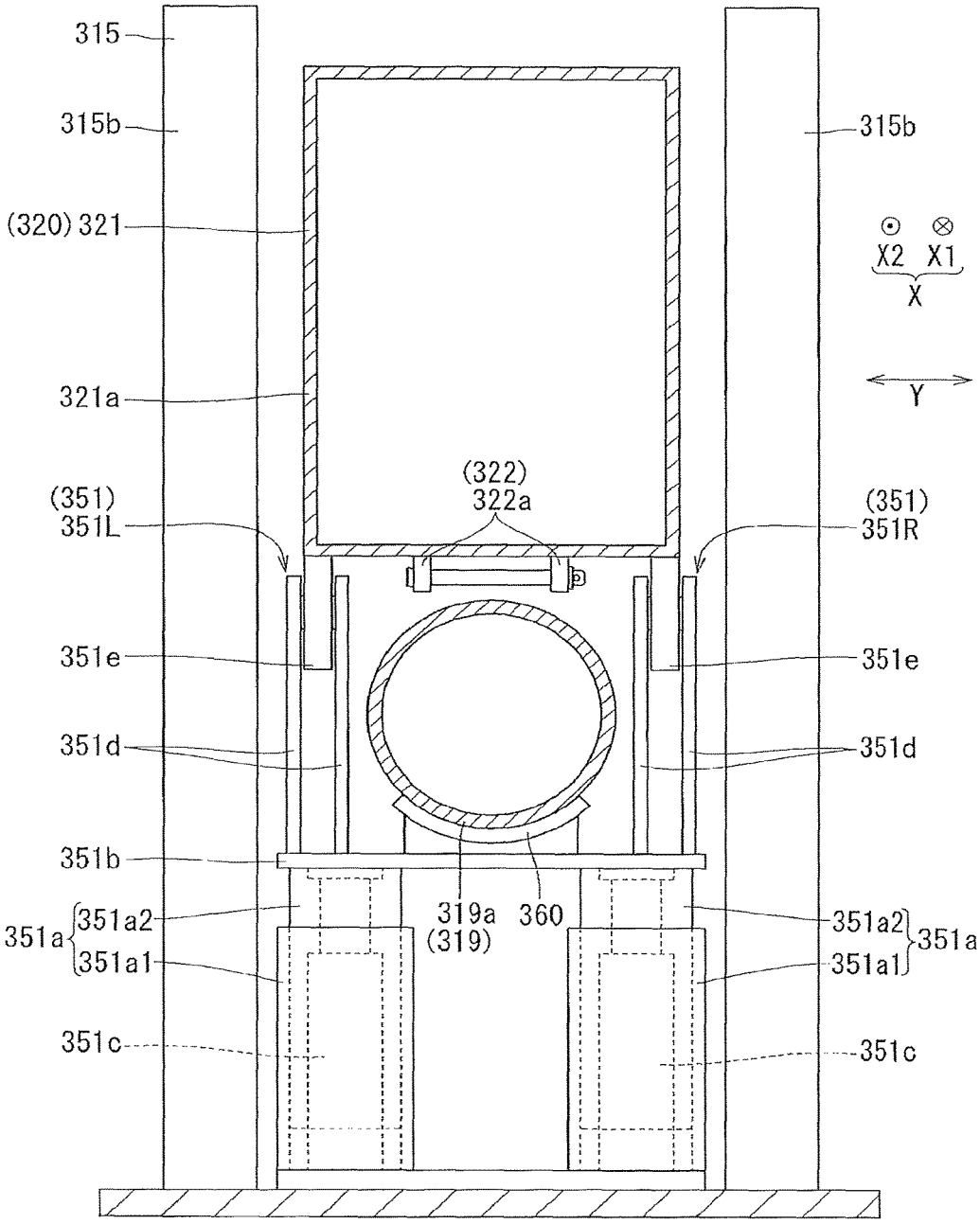
FIG. 17 is a sectional view seen from a direction of an arrow F17-F17 in FIG. 12.

The boom attach/detach device 301 includes a crane 310, a truck 340 (transport carriage), a boom supporting device 350 (boom supporting portion), and a cylinder receiving base 360 (see FIG. 17). The crane 310 includes a lower travelling body 311, an upper slewing body 313, a rising and falling cylinder 319 (drive cylinder), and a boom 320.

The upper slewing body 313 includes a slewing frame 315. The slewing frame 315 includes a bottom plate 315*a* and a boom supporting bracket 315*b*. The boom supporting bracket 315*b* upwardly protrudes from the bottom plate 315*a*. In FIG. 12 to FIG. 15, the upper slewing body 313 is indicated by chain double-dashed lines.

Figure 13:
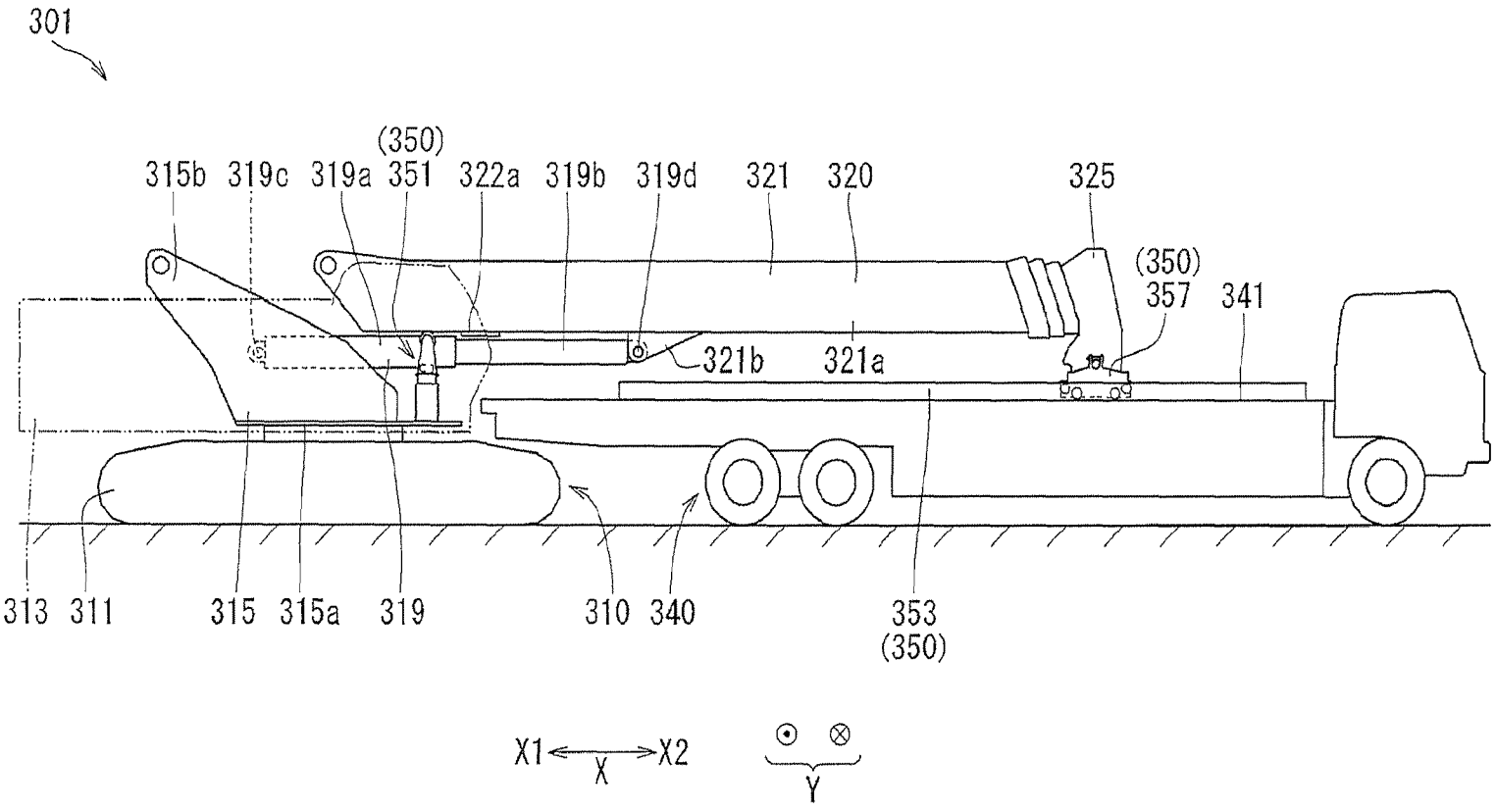
FIG. 13 is a view corresponding to FIG. 12, the view showing a boom 320 in the course of attachment/detachment thereof shown in FIG. 12.

The rising and falling cylinder 319 (drive cylinder) includes a cylinder tube 319*a* and a cylinder rod 319*b* (see FIG. 13). The cylinder tube 319*a* is attached (coupled) to the slewing frame 315 via a cylinder foot pin 319*c* and can rotate (rise and fall) with respect to the slewing frame 315.

As shown in FIG. 13, the cylinder rod 319*b* is inserted into the cylinder tube 319*a* to be movable in an axis direction of the cylinder tube 319*a*. The cylinder rod 319*b* is attached to the boom 320 via a cylinder rod pin 319*d* to be rotatable with respect to the boom 320.

The boom 320 is attached to the slewing frame 315 (to the upper slewing body 313) via a boom foot pin 320*a* as shown in FIG. 12. In the following, description will be made of a case where the boom 320 is arranged such that a longitudinal direction of the boom 320 is a horizontal direction (or an approximately horizontal direction). Unit booms constituting the boom 320 are a base end boom 321 and a front end boom 325.

Figure 14:
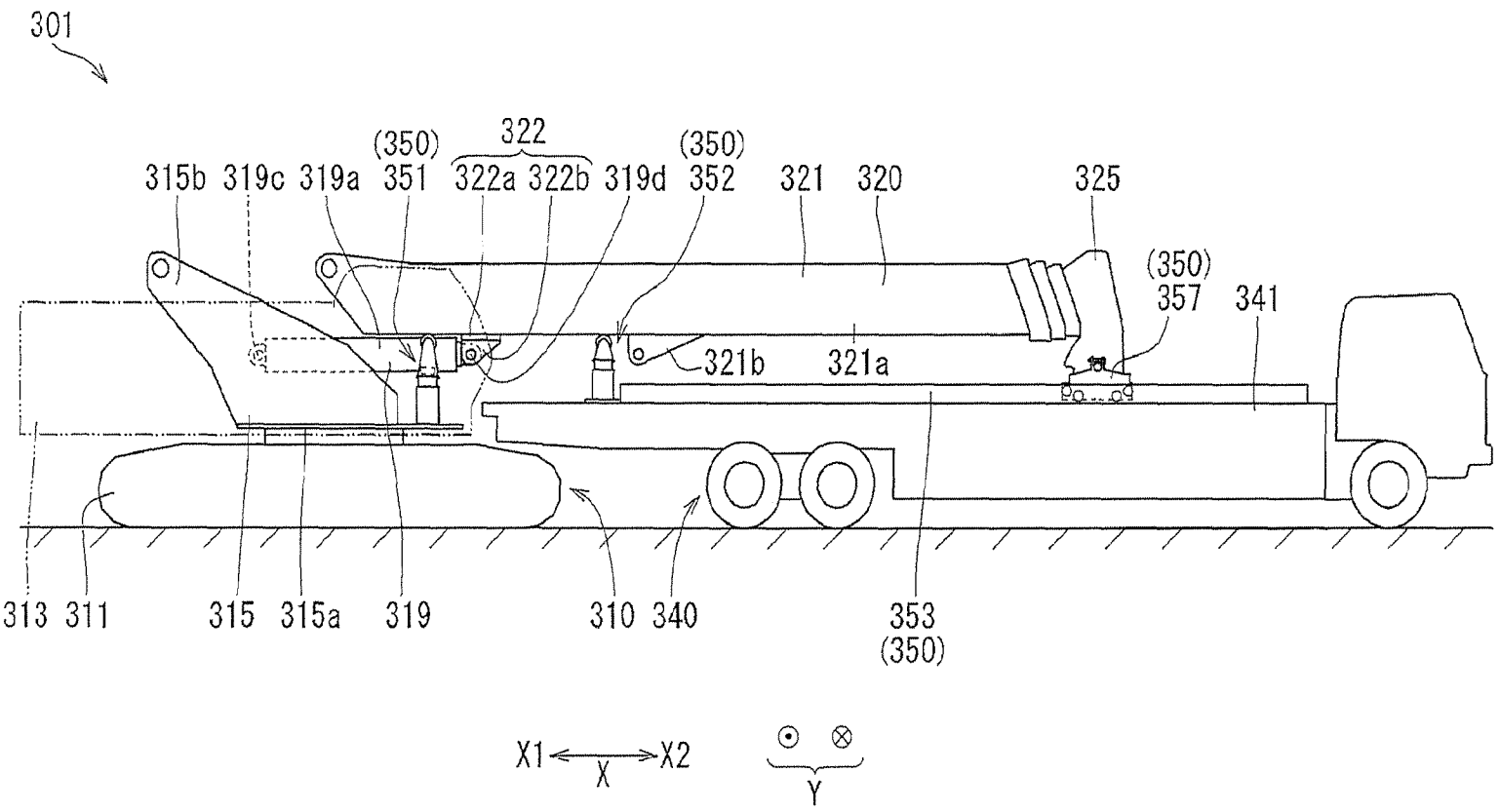
FIG. 14 is a view corresponding to FIG. 12, the view showing the boom 320 in the course of attachment/detachment thereof shown in FIG. 12.

The base end boom 321 (the basic boom) includes a box-shaped base end boom main body 321*a*, a bracket for rising and falling 321*b*, and a bracket for attachment/detachment 322 (a coupling member for attachment/detachment) as shown in FIG. 14.

Figure 15:
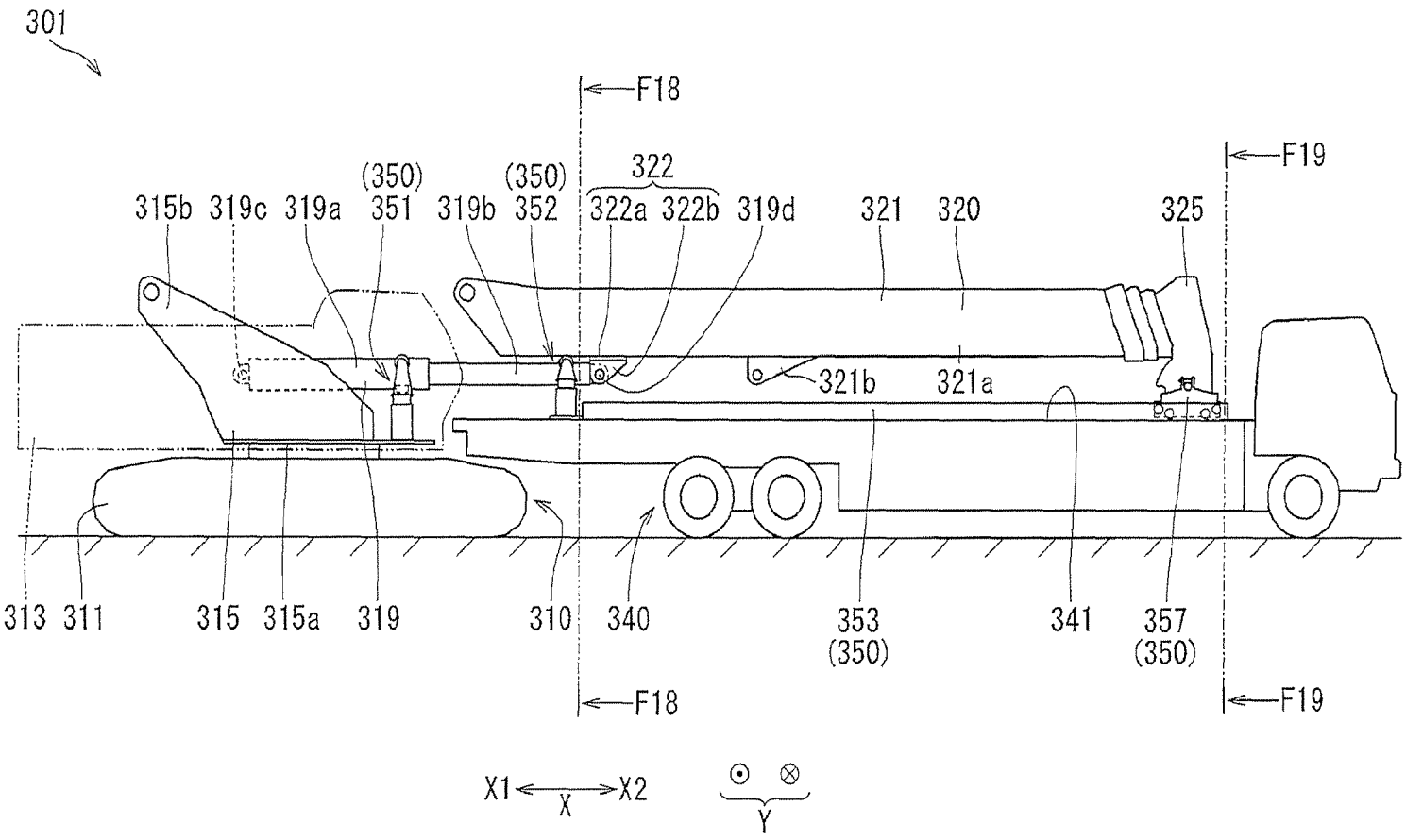
FIG. 15 is a view corresponding to FIG. 12, the view showing a state where the boom 320 shown in FIG. 12 is detached from a slewing frame 315.
Figure 16:
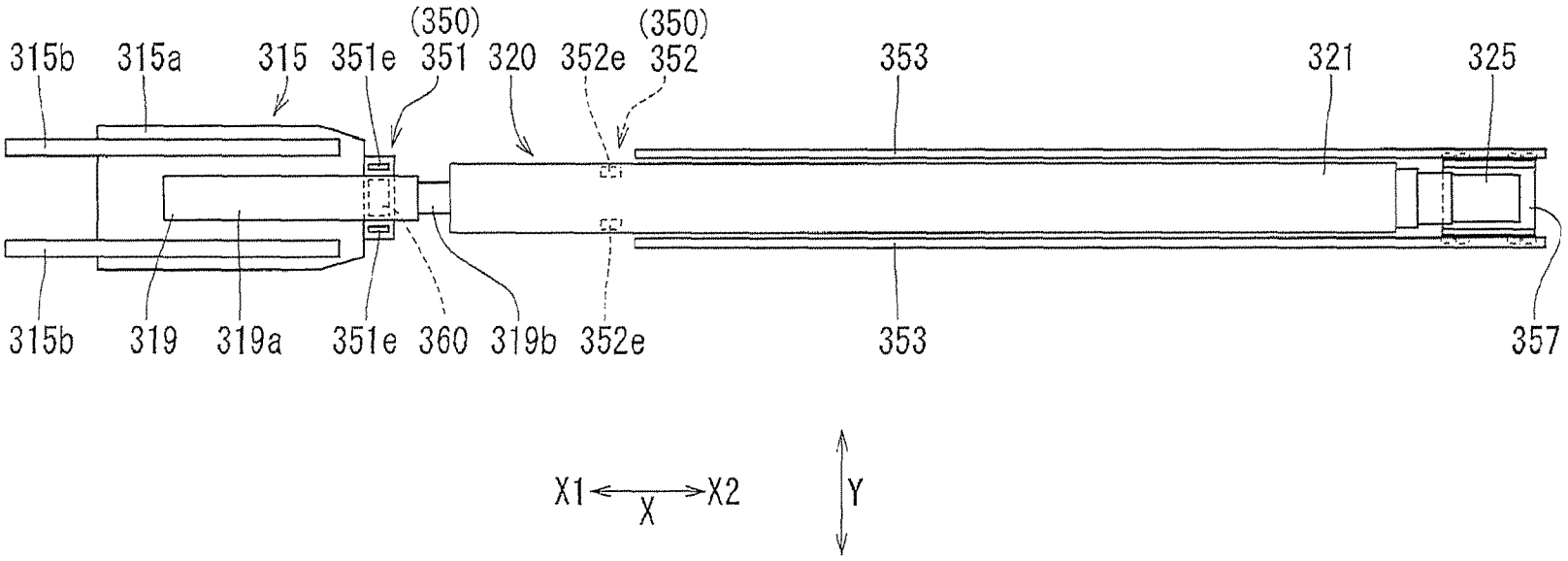
FIG. 16 is a view of a part of a boom attach/detach device 301 shown in FIG. 12, which part is seen from above.

To the bracket for rising and falling 321*b*, the rising and falling cylinder 319 is attached when the boom 320 is caused to rise and fall (during use of the boom and during crane work, see FIG. 12), and when the boom 320 is attached/detached to/from the upper slewing body 313 (during boom attachment/detachment work, see FIG. 13 to FIG. 15). As shown in FIG. 13, to the bracket for rising and falling 321*b*, a front end portion (boom front end side X2 end portion) of the cylinder rod 319*b* is attached via the cylinder rod pin 319*d*. The bracket for rising and falling 321*b* is provided (fixed) on a belly face (lower face) of the base end boom main body 321*a* to protrude downwardly from the belly face of the base end boom main body 321*a*.

To the bracket for attachment/detachment 322 (coupling member for attachment/detachment), the rising and falling cylinder 319 is attached during boom attachment/detachment work as shown in FIG. 15. To the bracket for attachment/detachment 322, the front end portion of the cylinder rod 319*b* can be attached via the cylinder rod pin 319*d*. The bracket for attachment/detachment 322 is provided (fixed) on the belly face of the base end boom main body 321*a* and downwardly protrudes from the belly face of the base end boom main body 321*a*. The bracket for attachment/detachment 322 is arranged more to a boom rear end side X1 than the bracket for rising and falling 321*b*. The bracket for attachment/detachment 322 is configured not to interfere with the rising and falling cylinder 319 when the rising and falling cylinder 319 is not attached to the bracket for attachment/detachment 322. Specifically, at least a part of the bracket for attachment/detachment 322 is attachable/detachable to/from the base end boom 321. The bracket for attachment/detachment 322 includes a bracket for attachment/detachment supporting portion 322*a* and a bracket main body for attachment/detachment 322*b*. The bracket for attachment/detachment supporting portion 322*a* is fixed to the belly face of the base end boom main body 321*a*.

The bracket main body for attachment/detachment 322*b* is attachable/detachable to/from the bracket for attachment/detachment supporting portion 322*a*, and is attached, for example, to the bracket for attachment/detachment supporting portion 322*a* via a pin (see FIG. 17). The bracket main body for attachment/detachment 322*b*, a part to which the rising and falling cylinder 319 is attached, protrudes downwardly from the bracket for attachment/detachment supporting portion 322*a*.

Figure 20:
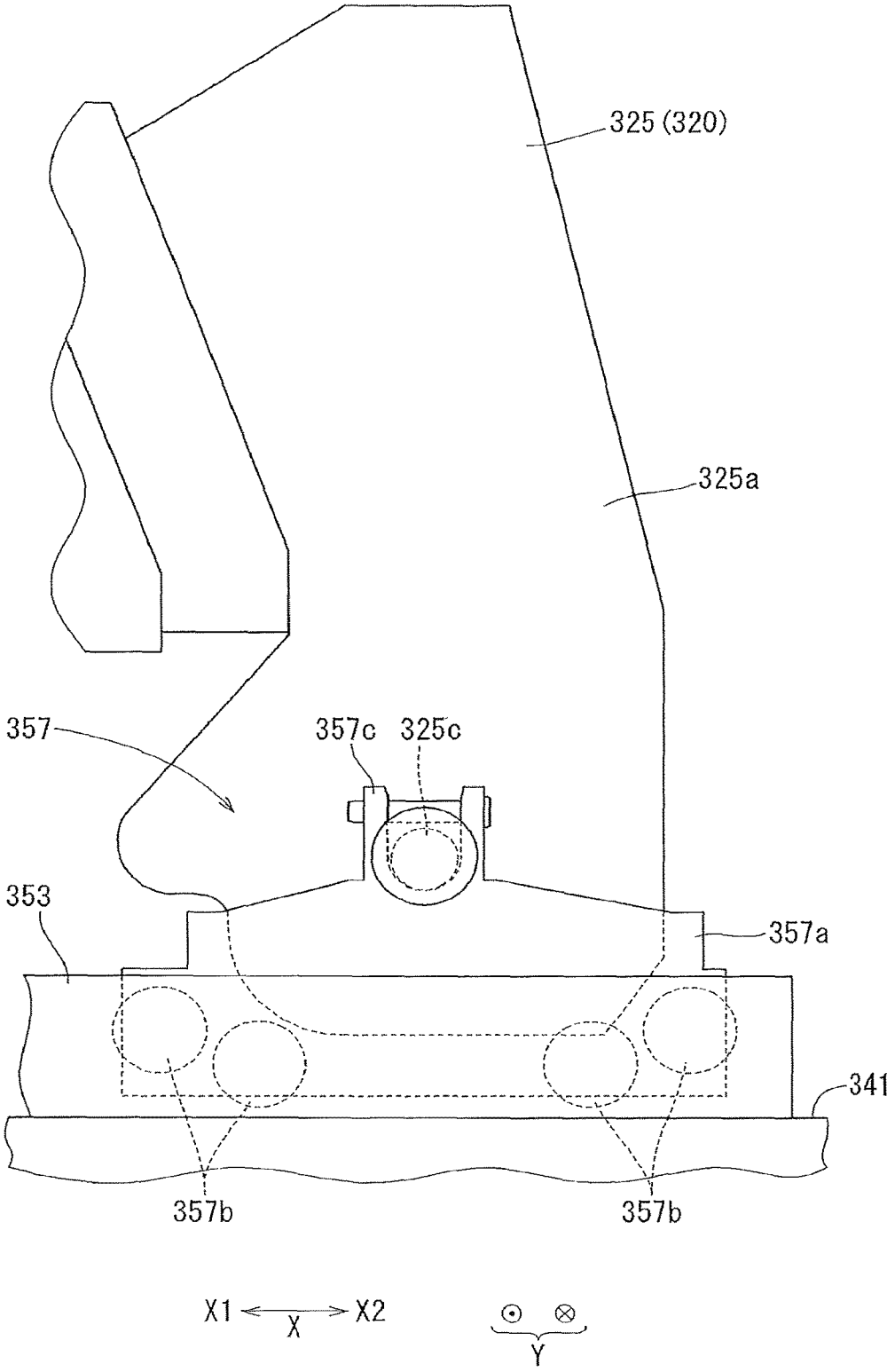
FIG. 20 is a view showing the periphery of a carriage 347 shown in FIG. 12.

A front end portion (boom front end side X2 end portion) of the front end boom 325 includes a side plate 325*a* and a boom point pin 325*c* as shown in FIG. 20.

The truck 340 (transport carriage) is a vehicle which transports the boom 320 and includes a platform 341 as shown in FIG. 14.

The boom supporting device 350 (boom supporting portion) is a device for supporting the boom 320. The boom supporting device 350 supports the boom 320 from below. The boom supporting device 350 includes a first guide roller device 351, a second guide roller device 352, a rail 353, and a carriage 357.

The first guide roller device 351 supports a rear end side part (a part closer to the boom rear end side X1 than to a central part of the boom 320 in a boom axis direction X) of the boom 320. The first guide roller device 351 is provided (disposed) at the slewing frame 315. As shown in FIG. 17, the first guide roller device 351 supports the base end boom 321, and supports the belly face of the base end boom main body 321*a* from below, for example, supports both outer side parts in a boom width direction Y (e.g., both outer side end portions) of the belly face of the base end boom main body 321*a*. The first guide roller device 351 includes two unit devices, including a first guide roller device 351L and a first guide roller device 351R. The first guide roller device 351L and the first guide roller device 351R are arranged spaced apart in the boom width direction Y so as not to interfere with the cylinder tube 319*a* (to avoid the cylinder tube 319*a*). The first guide roller device 351L and the first guide roller device 351R are configured to be symmetrical to each other when seen from the boom axis direction X. In the following, the first guide roller device 351L will be mainly described, and description of the first guide roller device 351R will be omitted. The first guide roller device 351L includes an extensible frame 351*a*, a frame coupling portion 351*b*, a lifting cylinder 351*c*, a guide roller supporting portion 351*d*, and a guide roller 351*e*.

The extensible frame 351*a* is a box-shaped member extensible in a vertical direction. The extensible frame 351*a* includes, for example, an outer side frame 351*a*1 and an inner side frame 351*a*2. The inner side frame 351*a*2 is arranged on the inner side than the outer side frame 351*a*1 and protrudes more upwardly than the outer side frame 351*a*1.

The frame coupling portion 351*b* couples an upper end portion of the extensible frame 351*a* of the first guide roller device 351L and an upper end portion of the extensible frame 351*a* of the first guide roller device 351R. The frame coupling portion 351*b* is, for example, plate-shaped with a thickness direction as the vertical direction.

The lifting cylinder 351*c* (support position lifting device) raises and lowers the guide roller 351*e*, thereby causing a support position of the boom 320 by the guide roller 351*e* to be raised and lowered. The lifting cylinder 351*c* raises and lowers the cylinder receiving base 360, thereby causing a support position of the cylinder tube 319*a* by the cylinder receiving base 360 to be raised and lowered. The lifting cylinder 351*c* is arranged (housed) inside the extensible frame 351*a*. The lifting cylinder 351*c* causes the extensible frame 351*a* to extend and contract in the vertical direction, and more specifically, causes the inner side frame 351*a*2 to be raised and lowered with respect to the outer side frame 351*a*1. The lifting cylinder 351*c* is, for example, a hydraulic cylinder or the like.

The guide roller supporting portion 351*d* is a part which supports the guide roller 351*e* and upwardly protrudes from the extensible frame 351*a*. The guide roller supporting portion 351*d* is formed of two plates sandwiching the guide roller 351*e*, for example.

The guide roller 351*e* is a part which fits the belly face of the boom 320 (the base end boom 321) to support the belly face. The guide roller 351*e* is rotatable with respect to the guide roller supporting portion 351*d* and rotates along with movement of the base end boom 321 shown in FIG. 14 in the boom axis direction X.

The second guide roller device 352, the rail 353, and the carriage 357 are each arranged more to the boom front end side X2 than the slewing frame 315 and arranged more to the boom front end side X2 than the upper slewing body 313. The second guide roller device 352, the rail 353, and the carriage 357 are each arranged at positions away from the slewing frame 315 (in a state of being separated from the slewing frame 315) and arranged at positions away from the upper slewing body 313. Specifically, the second guide roller device 352, the rail 353, and the carriage 357 are each provided on the truck 340, and more specifically, mounted (arranged) on the platform 341.

Figure 18:
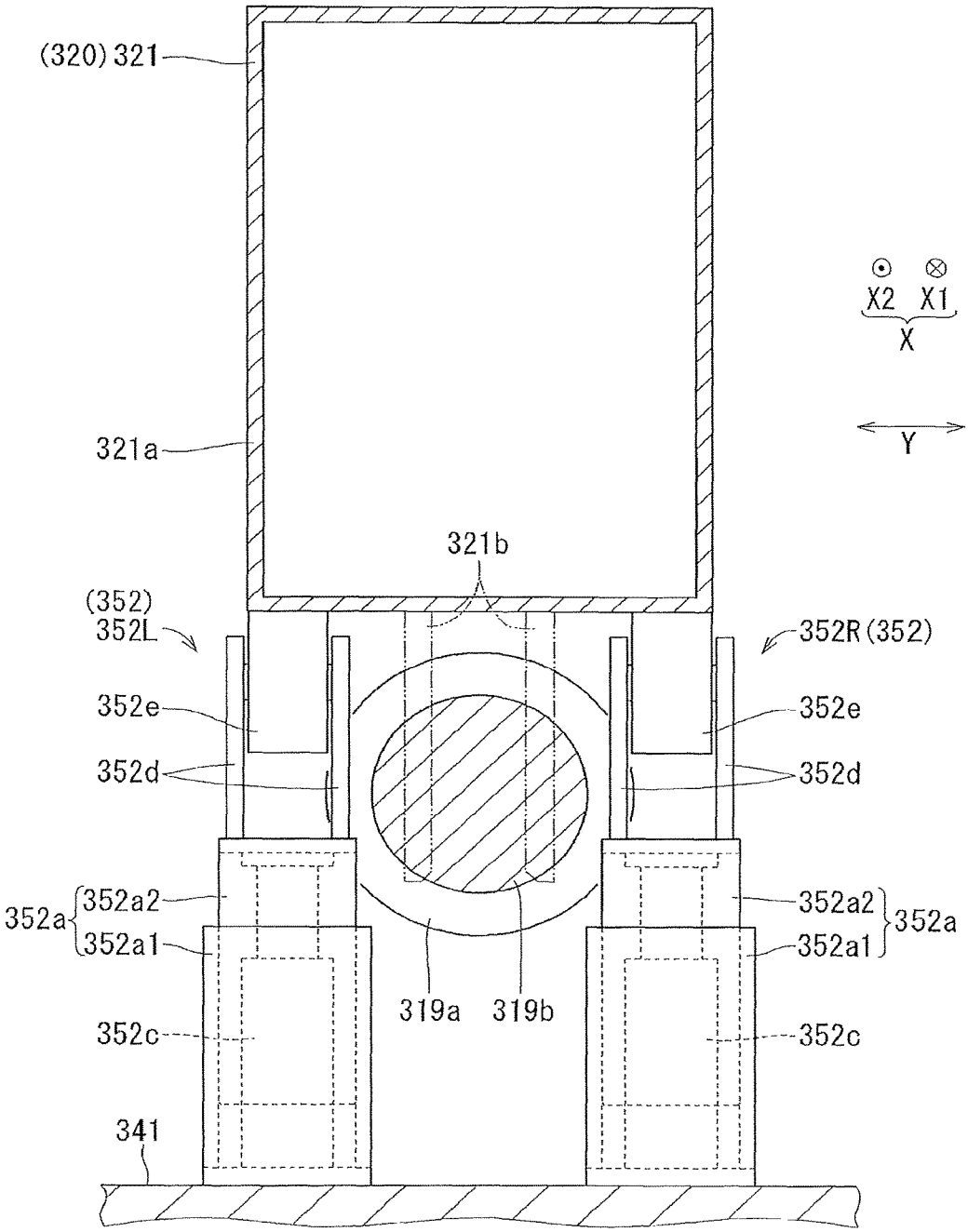
FIG. 18 is a sectional view seen from a direction of an arrow F18-F18 in FIG. 15.

The second guide roller device 352 supports the rear end side part of the boom 320 and the central part thereof in the boom axis direction X. The second guide roller device 352 is configured approximately similarly to the first guide roller device 351. In the following, description will be made mainly of differences of the second guide roller device 352 from the first guide roller device 351. As shown in FIG. 18, the second guide roller device 352 includes two unit devices, including a second guide roller device 352L and a second guide roller device 352R. The second guide roller device 352L and the second guide roller device 352R are arranged so as not to interfere with the cylinder rod 319*b* and arranged so as not to interfere with the bracket for rising and falling 321*b*. The second guide roller device 352L and the second guide roller device 352R each include an extensible frame 352*a* (an outer side frame 352*a*1 and an inner side frame 352*a*2), a lifting cylinder 352*c*, a guide roller supporting portion 352*d*, and a guide roller 352*e*. The second guide roller device 352R and the second guide roller device 352L are configured to be independent from each other (right and left independent). Specifically, the second guide roller device 352 is not provided with a member corresponding to the frame coupling portion 351*b* of the first guide roller device 351 shown in FIG. 17. A width of the guide roller 352*e* (a dimension in the boom width direction Y) shown in FIG. 18 is larger than a width of the guide roller 351*e* of the first guide roller device 351 shown in FIG. 17.

Figure 19:
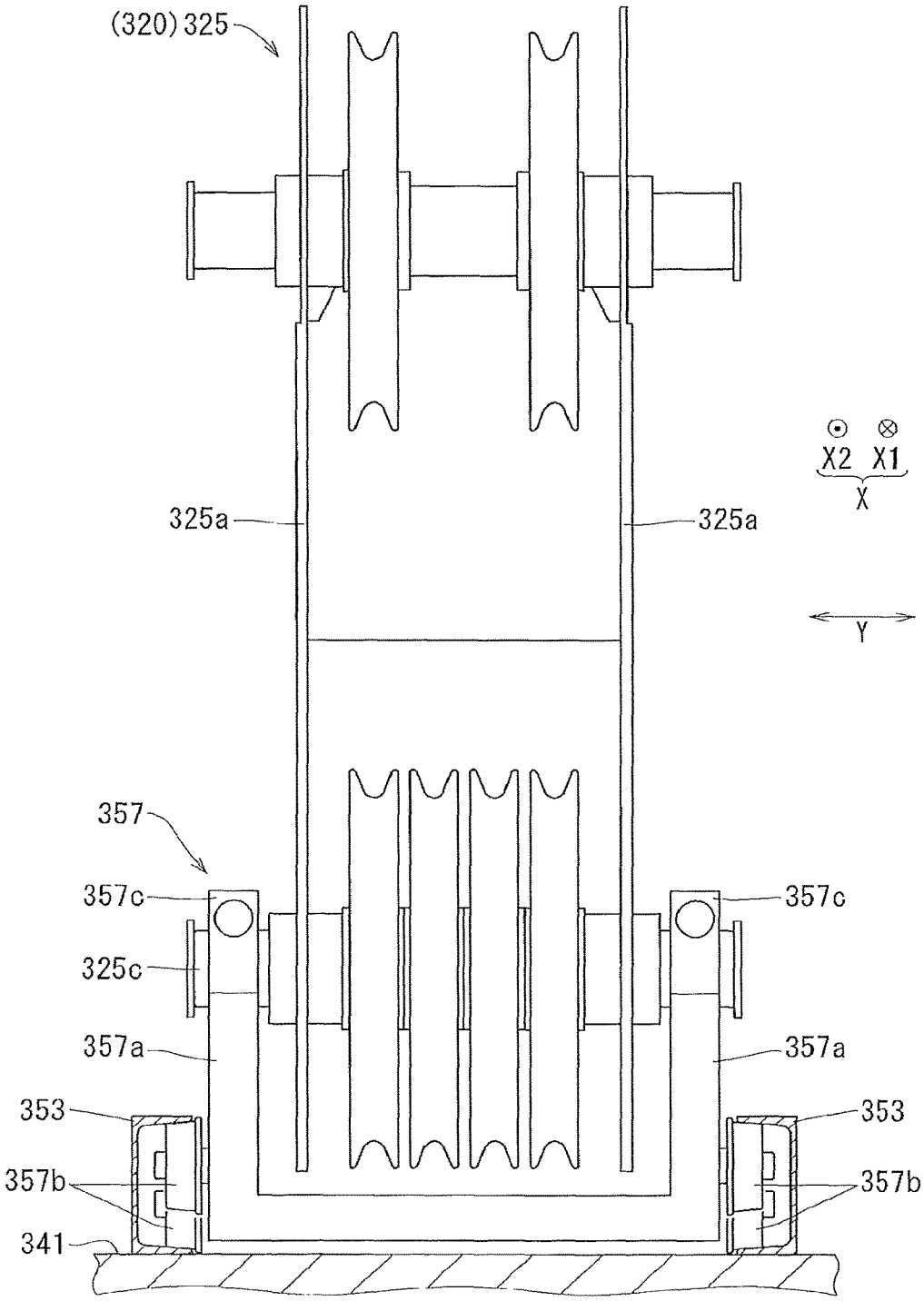
FIG. 19 is a sectional view seen from a direction of an arrow F19-F19 in FIG. 15.

The rail 353 is a rod-shaped member extending in the boom axis direction X as shown in FIG. 14. A plurality of, specifically, two rails 353 are provided spaced apart in the boom width direction Y as shown in FIG. 19. A cross section of the rail 353 seen from the boom axis direction X is, for example, C-shaped, or may be I-shaped or the like.

The carriage 357 is movable in the boom axis direction X along the rail 353 shown in FIG. 20. The carriage 357 supports the boom 320, and specifically, supports the front end boom 325 and supports the front end portion of the front end boom 325 (the boom front end side X2 end portion). The carriage 357 includes a carriage frame 357*a*, a carriage roller 357*b*, and a boom point pin fixing portion 357*c*. The carriage frame 357*a* is a frame which supports the carriage roller 357*b* and the boom point pin fixing portion 357*c*.

The carriage roller 357*b* is a member which causes the carriage 357 to be movable along the rail 353. The carriage roller 357*b* is attached to the carriage frame 357*a* to be rotatable around an axis of the carriage roller 357*b* with respect to the carriage frame 357*a*. A plurality of, for example, four (a total of eight) carriage rollers 357*b* are provided for one rail 353. As shown in FIG. 19, the carriage roller 357*b* includes rollers (two for one rail 353, a total of four) fitting a lower face of the rail 353. The carriage roller 357*b* includes rollers (two for one rail 353, a total of four) fitting an upper face of the rail 353 when the carriage 357 moves upwardly.

The boom point pin fixing portion 357*c* supports the front end boom 325, and more specifically, supports the boom point pin 325*c*, and has a U-shaped recess for supporting (receiving) the boom point pin 325*c* from below as shown in FIG. 20. The boom point pin fixing portion 357*c* fixes the boom point pin 325*c* to the boom point pin fixing portion 357*c* by, for example, a pin. As shown in FIG. 19, two boom point pin fixing portions 357*c* are provided spaced apart in the boom width direction Y to support the boom point pin 325*c* at both outer sides of the side plate 325*a* in the boom width direction Y. The boom point pin fixing portion 357*c* upwardly protrudes from the carriage frame 357*a*.

The cylinder receiving base 360 is a base which receives (supports from below) the cylinder tube 319*a* of the rising and falling cylinder 319 as shown in FIG. 17. The cylinder receiving base 360 is provided in the slewing frame 315. The cylinder receiving base 360 is provided in the first guide roller device 351, and is arranged between the two guide roller supporting portions 351*d* (between the portions in the boom width direction Y), and is disposed on an upper face of the frame coupling portion 351*b*. The cylinder receiving base 360 has a shape that can receive a lower face of the cylinder tube 319*a*, specifically, a U-shape or an arc-shape seen from the boom axis direction X.

(Operation)

An outline of operation of the boom attach/detach device 301 shown in FIG. 12 is as follows. Coupling between the slewing frame 315 and the boom 320 by the boom foot pin 320*a* is cut off. Additionally, the boom 320 is supported at a position more to the boom front end side X2 than the slewing frame 315 and supported at a position more to the boom front end side X2 than the upper slewing body 313. Preferably, the boom 320 is further supported on the slewing frame 315. Then, extension and contraction of the rising and falling cylinder 319 causes the boom 320 to move in the boom axis direction X. In the example shown below, at the time of attachment/detachment of the boom 320, the rising and falling cylinder 319 extends and contracts twice (extends twice and contracts twice). This operation causes the boom 320 to be attached/detached to/from the upper slewing body 313. Details of the operation of the boom attach/detach device 301 are as follows.

When the boom 320 is changed from a position where boom 320 is attached to the upper slewing body 313 (a body attachment position) to a position where the boom 320 is mounted on the truck 340 (a transport carriage position) (at the detachment of the boom 320), operation of the boom attach/detach device 301 to be conducted is as follows. In the following, description will be made following the order of steps (the order of steps may be appropriately changed).

[Step A]

The first guide roller device 351 and the cylinder receiving base 360 (see FIG. 16) are disposed on the slewing frame 315. Additionally, the carriage 357 is disposed on the rail 353.

[Step B]

The boom 320 is lowered by the rising and falling cylinder 319 and the boom 320 (the front end boom 325) is supported by the carriage 357. Next, as shown in FIG. 20, the boom point pin 325*c* is fixed to the boom point pin fixing portion 357*c*.

[Step C]

Drive of the lifting cylinder 351*c* shown in FIG. 17 causes the guide roller 351*e* and the cylinder receiving base 360 to be raised and lowered. This raising and lowering allows the guide roller 351*e* to support the boom 320 (the base end boom 321). Additionally, the cylinder receiving base 360 supports the cylinder tube 319*a*.

[Step D]

The boom foot pin 320*a* shown in FIG. 12 is detached from the boom rear end side X1 end portion and the boom supporting bracket 315*b* of the boom 320.

[Step E]

By operation by an operator, the rising and falling cylinder 319 is extended. Then, the boom 320 moves to the boom front end side X2. At this time, the boom 320 moves to the boom front end side X2 while being supported by the first guide roller device 351 and the carriage 357. As a result, the boom rear end side X1 end portion of the boom 320 separates from the boom supporting bracket 315*b* to the boom front end side X2. As shown in FIG. 13, when a distance between the boom rear end side X1 end portion of the boom 320 and the boom supporting bracket 315*b* in the boom axis direction X becomes a predetermined distance, extension of the rising and falling cylinder 319 is stopped.

[Step F]

The cylinder rod pin 319*d* is detached from the cylinder rod 319*b* and the bracket for rising and falling 321*b*. Next, the rising and falling cylinder 319 is contracted.

[Step G]

As shown in FIG. 14, the second guide roller device 352 is disposed on the platform 341, for example, arranged more to the boom rear end side X1 (the slewing frame 315 side) than the bracket for rising and falling 321*b*.

[Step H]

The bracket for attachment/detachment 322 is disposed at the boom 320. More specifically, the bracket main body for attachment/detachment 322*b* is attached to the bracket for attachment/detachment supporting portion 322*a*. Then, the cylinder rod pin 319*d* is attached to the cylinder rod 319*b* and the bracket for attachment/detachment 322.

[Step I]

The rising and falling cylinder 319 is extended. Consequently, the boom 320 moves to the boom front end side X2 in the boom axis direction X. As shown in FIG. 15, at this time, the boom 320 moves to the boom front end side X2 while being supported by the carriage 357 and the second guide roller device 352. As a result, the boom 320 is arranged at the transport carriage position (the position on the platform 341).

[Step J]

The cylinder rod pin 319*d* is detached from the cylinder rod 319*b* and the bracket for attachment/detachment 322. Then, the rising and falling cylinder 319 is contracted.

[Step K]

The boom 320 is transported by the truck 340.

When the position of the boom 320 is changed from the transport carriage position to the body attachment position (see FIG. 12) (at the time of attachment of the boom 320), operation of the boom attach/detach device 301 is conducted in the order of steps reverse to that of the operation at the time of detachment of the boom 320.

Effect of Eighth Invention

Effects obtained by the boom attach/detach device 301 shown in FIG. 12 are as follows.

[Configuration 8]

The drive cylinder is the rising and falling cylinder 319 which is attached to the upper slewing body 313 to cause the boom 320 to rise and fall with respect to the upper slewing body 313.

In the Configuration 8, since the rising and falling cylinder 319 is used for attaching/detaching the boom 320, it is not necessary to place a member necessary for operating the rising and falling cylinder 319 outside the upper slewing body 313, so that attaching/detaching work of the boom 320 can be conducted with ease.

A specific example of this effect is as follows. For example, as power for attaching/detaching the boom 320 to/from the upper slewing body 313, an extensible cylinder for causing the boom 320 to extend and contract (see the extensible cylinder 31 shown in FIG. 2) can be used. Here, a hydraulic pump for supplying pressure oil to the extensible cylinder is arranged at the upper slewing body 313, and the extensible cylinder is arranged inside the boom 320. Therefore, with a hydraulic hose (see the hydraulic hose for extension 33 shown in FIG. 2) being connected to the upper slewing body 313 and the extensible cylinder, attachment/detachment of the boom 320 should be conducted. Therefore, since it is necessary to take the hydraulic hose outside the upper slewing body 313, laying work of the hydraulic hose is required. On the other hand, in the present embodiment, since the rising and falling cylinder 319 is used for attaching/detaching the boom 320, it is not necessary to take the hydraulic hose out of the upper slewing body 313, resulting in eliminating the need of the laying work. Accordingly, as compared with a case requiring laying work of the hydraulic hose, attachment/detachment work of the boom 320 can be conducted with ease.

Effect of Ninth Invention

As shown in FIG. 15, the boom 320 includes the bracket for rising and falling 321*b* and the bracket for attachment/detachment 322. The rising and falling cylinder 319 is attached to the bracket for rising and falling 321*b* when the boom 320 is caused to rise and fall.

[Configuration 9]

The bracket for attachment/detachment 322 is arranged more to the boom rear end side X1 (the boom rear end side) than the bracket for rising and falling 321*b*, and the rising and falling cylinder 319 can be attached.

The boom attach/detach device 301 includes the Configuration 9. Accordingly, even when the bracket for rising and falling 321*b* is located more to the boom front end side X2 than the front end portion of the rising and falling cylinder 319 when the rising and falling cylinder 319 extended the most, the rising and falling cylinder 319 is allowed to move the boom 320 in the boom axis direction X via the bracket for attachment/detachment 322. Accordingly, as compared with a case where the bracket for attachment/detachment 322 is not provided, the boom 320 can be moved further away from the upper slewing body 313 to the boom front end side X2, or the boom 320 can be moved from the position on the boom front end side X2 closer to the upper slewing body 313. Accordingly, attachment/detachment of the boom 320 can be appropriately conducted.

Effect of Tenth Invention

[Configuration 10]

The boom attach/detach device 301 includes the cylinder receiving base 360 as shown in FIG. 17. The cylinder receiving base 360 is provided in the slewing frame 315 of the upper slewing body 313 to receive the cylinder tube 319*a* of the rising and falling cylinder 319.

With the Configuration 10, at the time of attachment/detachment of the boom 320 shown in FIG. 12, the cylinder tube 319*a* is supported with respect to the slewing frame 315. Accordingly, the rising and falling cylinder 319 is allowed to appropriately move the boom 320 in the boom axis direction X. Accordingly, the boom 320 can be appropriately attached/detached. As a result of supporting of the cylinder tube 319*a* with respect to the slewing frame 315, a coupling portion between the rising and falling cylinder 319 and the boom 320 is supported with respect to the slewing frame 315. Accordingly, a member coupling the rising and falling cylinder 319 and the boom 320 (e.g., the cylinder rod pin 319*d*) can be appropriately attached/detached.

Effect of Eleventh Invention

[Configuration 11]

The boom supporting device 350 includes the rail 353 and the carriage 357. The rail 353 extends in the boom axis direction X. The carriage 357 is movable in the boom axis direction X along the rail 353 and supports the boom 320.

With the Configuration 11, the carriage 357 is allowed to securely support the boom 320 which moves in the boom axis direction X at the time of attachment/detachment of the boom 320. Accordingly, the boom 320 can be appropriately attached/detached.

Effect of Twelfth Invention

[Configuration 12]

The boom supporting device 350 (the first guide roller device 351) is further provided in the slewing frame 315 of the upper slewing body 313.

With the Configuration 12, the boom 320 can be more securely supported as compared with a case where the boom supporting device 350 is arranged only at a position more to the boom front end side X2 than the upper slewing body 313. Accordingly, the boom 320 can be appropriately attached/detached.

Effect of Sixteenth Invention

Effects obtained by the boom attach/detach method of the present embodiment are as follows.

[Configuration 16]

The drive cylinder is the rising and falling cylinder 319 which is attached to the upper slewing body 313 to cause the boom 320 to rise and fall with respect to the upper slewing body 313.

With this Configuration 16, the same effect as that described in the above "Effect of Eighth Invention" can be obtained.

(Modification)

The above respective embodiments may be variously modified. Components of the embodiments different from each other may be combined. For example, as power for attaching/detaching the boom 20 to/from the upper slewing body 13 shown in FIG. 2, the extensible cylinder 31 and the rising and falling cylinder 319 shown in FIG. 12 may be used. For example, when attachment/detachment of the boom 20 is conducted by the extensible cylinder 31 shown in FIG. 2, the first guide roller device 351 shown in FIG. 12 may be used.

Fixing or coupling may be conducted directly or conducted indirectly. For example, the rising and falling cylinder supporting device 19*s* shown in FIG. 2 may be directly fixed to the slewing frame 15, or like the cylinder receiving base 360 shown in FIG. 17, may be attached to the slewing frame 315 via a member such as the first guide roller device 351.

The lower travelling body 11 shown in FIG. 1 may be provided with a wheel. The crane 10 may be of a wheeled type. While the unit booms of the boom 20 shown in FIG. 2 have four stages, the number of stages may be two stages, three stages, or five or more stages.

In the above embodiment, the boom supporting device 50 is provided on the truck 40. However, the boom supporting device 50 may be provided on a transport carriage other than the truck 40, may be provided on a transport carriage which is not self-propelled, may be provided on, for example, a trailer, may be provided on, for example, a carriage dedicated to transportation of the boom 20, or may be integral with the carriage. Additionally, the boom supporting device 50 may not be provided on a transport carriage, but may be fixed to the ground or the floor.

Although in the above embodiment, the boom supporting device 50 is a device, but a part or the entire of the boom supporting device 50 may be a boom supporting portion which is not a device. The boom supporting portion, which is not a device, may be a block-shaped substance, for example, wood or the like.

As shown in FIG. 3, the boom front end side supporting device 60 supports the boom point pin 25*c* of the front end boom 25. However, the boom front end side supporting device 60 may support a part other than the boom point pin 25*c*, may support, for example, the side plate 25*a*, or may support, for example, a lower end portion of the side plate 25*a*. Additionally, the boom front end side supporting device 60 may support a unit boom (except for the base end boom 21) other than the front end boom 25. The lateral member 55 or the reinforcing member 63 may not be provided.

Although the number of the boom rear end side supporting devices 70 is two as shown in FIG. 2, the number may be one, or three or more. The boom rear end side supporting device 70 may be configured not to be height-adjustable and may be configured with, for example, a box-shaped member which is not nested, or the like. The boom rear end side supporting device 70 may not be movable in the boom axis direction X or fixed to, for example, the frame 51 or the platform 41.

The boom rear end side supporting device 70 may be provided with a load detection means for detecting a load of the boom 20. The load detection means enables detection whether the boom rear end side supporting device 70 appropriately supports the boom 20 or not when the boom foot pin 20*a* shown in FIG. 9C is detached. In a case where the lifting cylinder 85 shown in FIG. 6 is a hydraulic cylinder, the load detection means is a hydraulic sensor which detects, for example, a pressure of operation oil to be supplied to the hydraulic cylinder. This load detection means may be a load cell or the like.

Although in the above embodiment, the height of the top plate 83 may be changed by the lifting cylinder 85 as a hydraulic cylinder, the height of the top plate 83 may be changed using electric power by, for example, an electric motor or the like.

In the above embodiment, arrangement of the wheels 88 on the rail 53 makes the boom rear end side supporting device 70 be movable in the boom axis direction X. However, the wheel 88 may be replaced by, for example, a slide member or the like. The slide member is configured to be easily slidable with respect to the rail 53 and is, for example, a plate-shaped (sliding pad), and is made of, for example, resin. The wheel 88 or the slide member may not be arranged on the rail 53, but may be arranged beside the rail 53 (on the inner side or outer side in the boom width direction Y) or arranged in a groove or the like formed in the rail 53.

The procedure for detaching the boom 20 from the upper slewing body 13 and the procedure for attaching the boom 20 to the upper slewing body 13 in the above embodiment may be appropriately changed. Although in the second embodiment, the inclination of the upper slewing body 13 with respect to the ground is adjusted by the jack 211*c*, only the height may be adjusted without adjustment of the inclination.

As shown in FIG. 2, in the first and second embodiments, with the rising and falling cylinder 19 being connected to the upper slewing body 13, the boom 20 is attached/detached to/from the upper slewing body 13. However, the boom 20 may be also attached/detached to/from the upper slewing body 13, with the rising and falling cylinder 19 being connected to the boom 20 and being separated from the upper slewing body 13.

In the boom attach/detach device 301 of the third embodiment as shown in FIG. 12, the boom 320 may not be extensible.

Although the number of the brackets for attachment/detachment 322 shown in FIG. 14 is one in the above embodiment, the number may be two or more. Additionally, the bracket for attachment/detachment 322 may not be provided. Although the number of extensions and contractions of the rising and falling cylinder 319 necessary for attaching/detaching the boom 320 to/from the slewing frame 315 is two in the above embodiment, the number may be one, or three or more.

As shown in FIG. 15, in the above embodiment, the coupling between the cylinder rod 319*b* and the boom 320 during boom attachment/detachment work is realized by the bracket for attachment/detachment 322 (the coupling member for attachment/detachment) and the cylinder rod pin 319*d*. However, the coupling between the cylinder rod 319*b* and the boom 320 during boom attachment/detachment work may be realized by, for example, a member to which a wire or the like is attachable (the coupling member for attachment/detachment).

A similar device to the first guide roller device 351 or the second guide roller device 352 may be further provided on the slewing frame 315 or the platform 341.

Although the number of the carriage rollers 357*b* shown in FIG. 20 is eight in the above embodiment, the number may be less than eight or more than eight. As shown in FIG. 19, in the above embodiment, there are provided the carriage roller 357*b* fitting only the lower side face of the rail 353 and the carriage roller 357*b* fitting only the upper side face of the rail 353. However, the carriage roller 357*b* which fit both the upper side and lower side faces of the rail 353 may be provided. Although in the above embodiment, movement onto the carriage 357 is regulated by the rail 353 and the carriage roller 357*b*, the movement may not be regulated. Specifically, for example, the carriage roller 357*b* may be arranged on the upper face of the rail 353 (see the arrangement of the rail 53 and the wheel 88 shown in FIG. 7).

As shown in FIG. 19, in the above embodiment, fixing the boom point pin 325*c* to the boom point pin fixing portion 357*c* enables the boom 320 to be supported by the carriage 357. However, the carriage 357 may support the boom point pin 325*c* without fixing the boom point pin 325*c*. Additionally, the carriage 357 may support, for example, the side plate 325*a* of the front end boom 325. Additionally, the carriage 357 may support a unit boom (the base end boom 321 shown in FIG. 12, or the like) other than the front end boom 325.

In the above embodiment, the cylinder receiving base 360 shown in FIG. 17 is raised and lowered together with the guide roller 351*e* by the lifting cylinder 351*c*. However, separately from the lifting cylinder 351*c* for raising and lowering the guide roller 351*e* (for raising and lowering the boom 320), a lifting cylinder for raising and lowering the cylinder receiving base 360 may be provided. In this case, adjustment of a height of the guide roller 351*e* (a height of the boom 320) and adjustment of a height of the cylinder receiving base 360 can be conducted separately. Accordingly, positioning of the pin hole for the boom foot pin 320*a* shown in FIG. 12 and positioning of the pin hole for the cylinder rod pin 319*d* shown in FIG. 13 and FIG. 14 can be conducted appropriately.

REFERENCE SIGNS

1, 201, 301 boom attach/detach device
10, 310 crane
13, 313 upper slewing body
15, 315 slewing frame
19, 319 rising and falling cylinder (drive cylinder)
20, 320 boom
20*a*, 320*a* boom foot pin
31 extensible cylinder (drive cylinder)
40, 340 truck (transport carriage)
50, 350 boom supporting device (boom supporting portion)
53, 353 rail
60 boom front end side supporting device (boom front end side supporting portion)
70 boom rear end side supporting device (boom rear end side supporting portion)
71 first boom rear end side supporting device (first boom rear end side supporting portion)
72 second boom rear end side supporting device (second boom rear end side supporting portion)
85 lifting cylinder (support height changing portion)
211*c* jack
319*a* cylinder tube
321*b* bracket for rising and falling
322 bracket for attachment/detachment (coupling member for attachment/detachment)
357 carriage
360 cylinder receiving base
X boom axis direction
X1 boom rear end side
X2 boom front end side

The invention claimed is:

1. A boom attach/detach device of a crane, the device comprising:

an upper slewing body;

a boom attached to the upper slewing body via a boom foot pin so as to rise and fall;

a drive cylinder provided in the upper slewing body or the boom to drive the boom; and a boom supporting portion which supports the boom, wherein at least a part of the boom supporting portion is arranged more to a boom front end side than the upper slewing body, and when the drive cylinder conducts extension and contraction operation in a state where coupling between the upper slewing body and the boom by the boom foot pin is cut off, the boom supporting portion supports the boom so as to enable a rear end portion of the boom to move in a boom axis direction, and wherein the boom supporting portion includes:

a boom front end side supporting portion, a rail extending in the boom axis direction, and a boom rear end side supporting portion arranged more to a boom rear end side than the boom front end side supporting portion and the boom rear end side supporting portion is movable in the boom axis direction along the rail.

2. The boom attach/detach device of a crane according to claim 1, wherein the boom is extensible, and the drive cylinder is an extensible cylinder which causes the boom to extend and contract.

3. The boom attach/detach device of a crane according to claim 1, wherein the boom rear end side supporting portion includes a support height changing portion which changes a part supporting the boom to have an arbitrary height.

4. The boom attach/detach device of a crane according to claim 1, wherein a plurality of the boom rear end side supporting portions are provided spaced apart in the boom axis direction.

5. The boom attach/detach device of a crane according to claim 1, further comprising a jack which lifts up the upper slewing body to an arbitrary height.

6. The boom attach/detach device of a crane according to claim 1, wherein the drive cylinder is a rising and falling cylinder attached to the upper slewing body to cause the boom to rise and fall with respect to the upper slewing body.

7. The boom attach/detach device of a crane according to claim 6, wherein the boom includes:

a bracket for rising and falling to which the rising and falling cylinder is attached when causing the boom to rise and fall; and a coupling member for attachment/detachment which is arranged more to the boom rear end side than the bracket for rising and falling and to which the rising and falling cylinder is attachable.

8. The boom attach/detach device of a crane according to claim 6, further comprising a cylinder receiving base provided in a slewing frame of the upper slewing body to receive a cylinder tube of the rising and falling cylinder.

9. The boom attach/detach device of a crane according to claim 6, wherein the boom supporting portion is further provided in the slewing frame of the upper slewing body.

10. The boom attach/detach device of a crane according to claim 1, wherein the boom supporting portion is provided on a transport carriage for transporting the boom.

11. A boom attach/detach method for a crane, the crane including a boom attached to an upper slewing body via a boom foot pin so as to rise and fall; and a drive cylinder provided in the upper slewing body or the boom to drive the boom; a boom supporting portion which supports the boom, at least a part of the boom supporting portion is arranged more to a boom front end side than the upper slewing body, the boom supporting includes:

a boom front end side supporting portion, a rail extending in a boom axis direction, and a boom rear end side supporting portion arranged more to a boom rear end side than the boom front end side supporting and the boom rear end side supporting portion is movable in the boom axis direction along the rail, the method comprising in a state where the boom is supported at a position more to the boom front end side than the upper slewing body and coupling between the upper slewing body and the boom by the boom foot pin is cut off, causing the drive cylinder to conduct extension and contraction operation to enable a rear end portion of the boom and the boom rear end side supporting portion to move in the boom axis direction.

12. The boom attach/detach method for a crane according to claim 11, wherein the boom is extensible, and the drive cylinder is an extensible cylinder which causes the boom to extend and contract.

13. The boom attach/detach method for a crane according to claim 11, wherein the drive cylinder is a rising and falling cylinder attached to the upper slewing body to cause the boom to rise and fall with respect to the upper slewing body.

14. The boom attach/detach device of a crane according to claim 1, wherein the rail has a C-shaped or I-shaped cross-section.

15. The boom attach/detach device of a crane according to claim 1, wherein the rail is a first rail of the boom supporting portion and the boom supporting portion includes a second rail spaced apparat from the first rail in a boom width direction that is transverse to the boom axis direction.

16. The boom attach/detach device of a crane according to claim 15, wherein the boom supporting portion includes lateral members that extend in the boom width direction to connect the first rail and the second rail, and the boom front end side supporting portion is fixed to the first rail and the second rail at a position between the lateral members.

17. The boom attach/detach device of a crane according to claim 1, wherein the boom rear end supporting portion includes:

an outer frame, an inner frame arranged inside the outer frame and vertically moveable with respect to the outer frame to directly contact the boom, wheel supporting portions fixed to the outer frame, and wheels supported by the wheel supporting portions, the wheels being mounted direction on the rail and the wheels rotate to move the boom rear end supporting portion with respect to the rail.

* * * * *